US006223549B1

(12) United States Patent
Kasai

(10) Patent No.: US 6,223,549 B1
(45) Date of Patent: May 1, 2001

(54) REFRIGERATION CYCLE DEVICE, A METHOD OF PRODUCING THE DEVICE, AND A METHOD OF OPERATING THE DEVICE

(75) Inventor: Tomohiko Kasai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/238,641

(22) Filed: Jan. 28, 1999

(30) Foreign Application Priority Data

Apr. 24, 1998 (JP) ..... 10-114717

(51) Int. Cl.[7] ..... F25B 13/00
(52) U.S. Cl. ..... 62/324.1; 62/324.6; 62/470
(58) Field of Search ..... 62/324.1, 324.6, 62/470, 474, 475

(56) References Cited

U.S. PATENT DOCUMENTS

| | | | | |
|---|---|---|---|---|
| 3,175,342 | | 3/1965 | Balogh . | |
| 4,266,408 | | 5/1981 | Krause . | |
| 4,478,050 | * | 10/1984 | DiCarlo et al. | 62/470 X |
| 4,480,446 | | 11/1984 | Margulefsky et al. . | |
| 4,506,523 | * | 3/1985 | DiCarlo et al. | 62/470 |
| 4,912,937 | * | 4/1990 | Nakamura et al. | 62/324.1 X |
| 5,062,273 | * | 11/1991 | Lee et al. | 62/475 X |
| 5,184,480 | | 2/1993 | Kolpacke . | |
| 5,247,812 | | 9/1993 | Keltner . | |
| 5,309,733 | * | 5/1994 | Hayashida et al. | 62/324.6 X |
| 5,327,735 | | 7/1994 | Hatton . | |
| 5,347,817 | | 9/1994 | Kim . | |
| 5,357,766 | * | 10/1994 | Shiraishi et al. | 62/324.6 X |
| 5,515,690 | * | 5/1996 | Blackmon et al. | 62/475 X |
| 5,768,902 | * | 6/1998 | Nonaka et al. | 62/324.6 X |
| 5,953,934 | * | 9/1999 | Makino et al. | 62/470 |

FOREIGN PATENT DOCUMENTS

| | | | |
|---|---|---|---|
| 0672875 | | 9/1995 | (EP) . |
| 404151318 | * | 5/1992 | (JP) . |
| 7-83545 | | 3/1995 | (JP) . |

OTHER PUBLICATIONS

Nichireikou issued by The Refrigerant Conversion Promoting committee "Technology of applicating and servicing a device utilizing a refrigerant of HFC system" pp. 118–121.

* cited by examiner

*Primary Examiner*—William Doerrler
*Assistant Examiner*—Chen-Wen Jiang
(74) *Attorney, Agent, or Firm*—Oblon, Spivak, McClelland, Maier & Neustadt, P.C.

(57) ABSTRACT

A refrigeration cycle device having a first refrigeration circuit for circulating a refrigerant from a compressor through a heat exchanger on a heat source equipment side, a flow rate adjuster, a heat exchanger on an application side, and an accumulator in a sequential manner to the compressor, comprising an extraneous matter catching means for catching extraneous matters in the refrigerant provided between the heat exchanger on application side and the accumulator of the first refrigeration circuit, and an oil separating means for separating a refrigerating machine oil in the refrigerant to separate the extraneous matters and the refrigerating machine oil from the refrigerant, by such a structure only a heat source equipment A and an indoor unit B can be newly exchanged without exchanging connection pipes C and D for connecting the heat source equipment and the indoor unit after flushing operation for introducing a new refrigerant.

16 Claims, 13 Drawing Sheets

FIG. 4
(a)
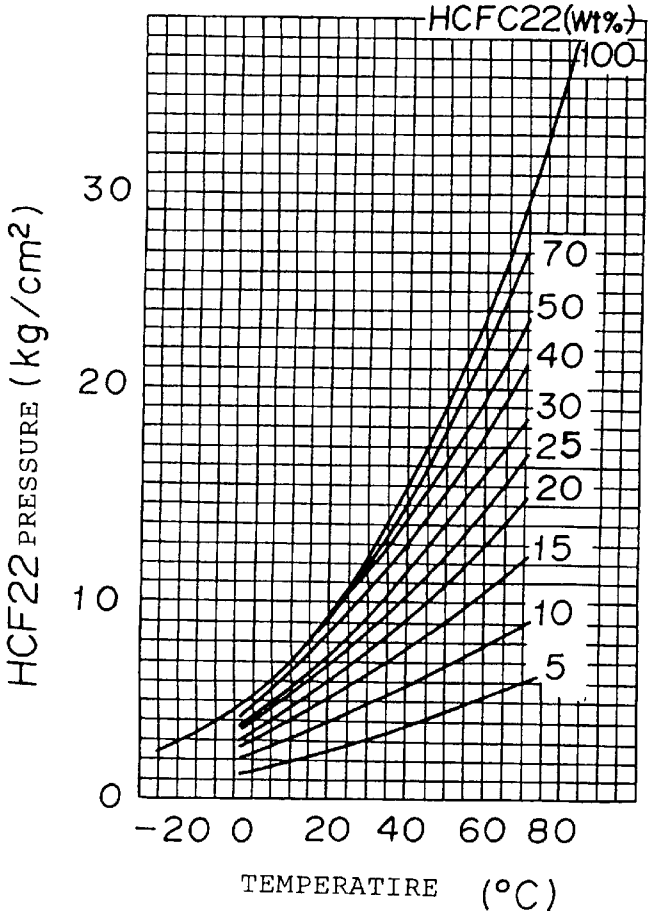
(b)
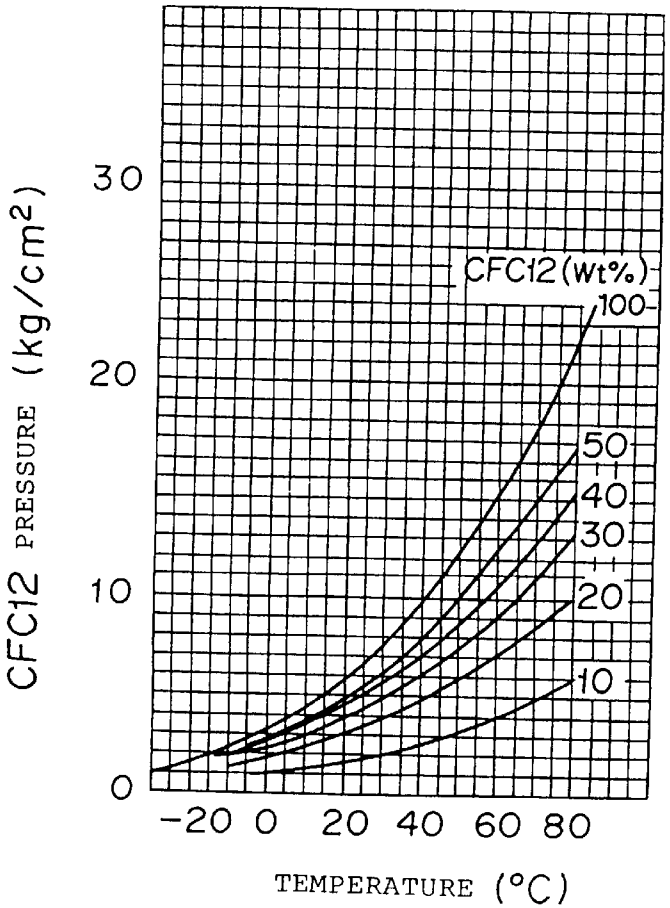

PRIOR ART FIG. 11

REFRIGERATION CYCLE DEVICE, A METHOD OF PRODUCING THE DEVICE, AND A METHOD OF OPERATING THE DEVICE

BACKGROUND OF THE INVENTION

1. Field of the Invention

The present invention relates to exchange of the refrigerant in a refrigeration cycle device, in particular, a refrigeration cycle device in which a refrigerant is newly exchanged while newly exchanging only a heat source equipment and an indoor unit without exchanging connection pipes for connecting the heat source equipment to the indoor unit, a method of exchanging the device, and a method of operating the device.

2. Discussion of Background

In FIG. 11, an air conditioner of a separate-type which is generally and conventionally used is shown. In FIG. 11, reference A designates a heat source equipment; numerical reference 1 designates a compressor; numerical reference 2 designates a four-way valve; numerical reference 3 designates a heat exchanger on a heat source equipment side; numerical reference 4 designates a first control valve; numerical reference 7 designates a second control valve; and numerical reference 8 designates an accumulator, wherein the numerical references 1 through 8 are built in the heat source equipment A. Reference B designates an indoor unit, which includes a flow rate adjuster 5 (or a flow control valve 5) and a heat exchanger 6 on an application side. The heat source equipment A and the indoor unit B are separately located and connected through a first connection pipe C and a second connection pipe D, whereby a refrigeration cycle is formed.

One end of the first connection pipe C is connected to the heat exchanger 3 on the heat source equipment side through the first control valve 4 and the other end of the first connection pipe C is connected to the flow rate adjuster 5. One end of the second connection pipe D is connected to the four-way valve 2 through the second control valve 7 and the other end of the second connection pipe D is connected to the heat exchanger 6 on the application side. Further, an oil return hole 8*a* is provided in a lower portion of an effluent pipe having a U-like shape of the accumulator 8.

A refrigerant flow of the air conditioner will be described in reference of FIG. 11. In FIG. 11, an arrow of solid line designates a flow in cooling operation and an arrow of broken line designates a flow in heating operation.

At first, the flow in cooling operation will be described. A gas refrigerant having a high-temperature and a high-pressure, which is compressed by the compressor 1 flows through the four-way valve 2 to the heat exchanger on the heat source equipment side 3, wherein it is condensed and liquefied by exchanging heat with a heat source medium such as air and water. Thus condensed and liquefied refrigerant flows through the first control valve 4 and the first connection pipe C to a flow rate adjuster 5, wherein it is depressurized to a low pressure to be in a two-phase state of a low pressure and evaporates and vaporized by exchanging heat with a medium on the application side such as air in the heat exchanger on the application side 6. Thus evaporated and vaporized refrigerant returns to the compressor 1 through the second connection pipe D, the second control valve 7, the four-way valve 2, and the accumulator 8.

In the next, a flow in heating operation will be described. A gas refrigerant in a high-temperature and a high-pressure which is compressed by the compressor 1 flows into the heat exchanger on the application side 6 through the four-way valve 2, the second control valve 7 and the second connection pipe D and is condensed and liquefied by exchanging heat with a medium on the application side such as air in the heat exchanger 6. Thus condensed and liquefied refrigerant flows into the flow rate adjuster 5, wherein it is depressurized to a low pressure to be a two phase state of a low pressure and evaporates and vaporizes by exchanging heat with a heat source medium such as air and water in the heat exchanger on the heat source equipment side 3 after passing through the first connection pipe C and the first control valve 4. Thus evaporating and vaporizing refrigerant returns to the compressor 1 through the four-way valve 2 and the accumulator 8.

Conventionally, chloro fluoro carbon (hereinbelow referred to as CFC) or hydro chloro fluoro carbon (hereinbelow referred to as HCFC) is used as a refrigerant for such an air conditioner. However, chlorine contained in the these molecules destructs an ozone layer in the stratosphere. Therefore, CFC was already abolished and production of HCFC was already started to regulate.

Instead of these, hydro fluoro carbon (hereinbelow referred to as HFC) which does not contain chlorine in its molecules is practically used for an air conditioner. When an air conditioner using CFC or HCFC is aged, it is necessary to substitute an air conditioner using HFC because the refrigerant such as CFC and HCFC has been abolished or regulated to produce.

Because the heat source equipment A and the indoor unit B use a refrigerating machine oil, an organic material, and an heat exchanger respectively for HFC are different from those for HCFC, it is necessary to change a refrigerating machine oil, an organic material, and a heat exchanger, respectively for exclusive use of HFC. Further, because the heat source equipment A and the indoor unit B respectively for CFC or HCFC may be aged, it is necessary to exchange these and such an exchange is relatively easy.

On the other hand, because in a case that the first connection pipe C and the second connection pipe D connecting the heat source equipment A to the indoor unit B are long or are buried in a pipe shaft, above a ceiling, in a like location of a building, it is difficult to exchange for new pipes and existing pipes are ordinarily not decrepit, it is possible to simplify piping work by using the existing first connection pipe C and the existing second connection pipe D for the air conditioner using CFC or HCFC.

However, in the first connection pipe C and the second connection pipe D used for the air conditioner utilizing CFC or HCFC, a refrigerating machine oil of a mineral oil for the air conditioner utilizing CFC or HCFC and a deteriorated substance of a refrigerating machine oil retain as a sludge.

FIG. 12 shows a critical solubility curve for a exhibiting solubility of a refrigerating machine oil for HFC with a refrigerant of HFC (R407C) when a mineral oil is mixed to the refrigerant, wherein an abscissa designates a quantity of oil (WT %) and an ordinate designates a temperature (° C.). When a certain quantity or more of a mineral oil is included in a refrigerating machine oil (a synthetic oil such as an ester oil or an ether oil) of an air conditioner utilizing HFC, compatibility with a HFC refrigerant is lost as shown in FIG. 12, wherein in a case that a liquid refrigerant is accumulated in a accumulator 8, the refrigerating machine oil for HFC separates and flows on the liquid refrigerant, whereby a sliding portion of compressor is seized because the refrigerating machine oil does not return from an oil return hole 8*a* located in a lower portion of the accumulator 8 to the compressor.

Further, when a mineral oil is mixed, the refrigerating machine oil for HFC is deteriorated. Further, when CFC or HCFC is mixed in the refrigerating machine oil for HFC, it is deteriorated by a component of chlorine contained in CFC or HCFC. Further, the refrigerating machine oil for HFC is deteriorated by a component of chlorine contained in sludge of a deteriorated substance of refrigerating machine oil for CFC or HCFC.

Therefore, a first connection pipe C and a second connection pipe D, which were used in an air conditioner utilizing CFC or HCFC, were conventionally cleaned by a flushing liquid for exclusive use, (ex. HCFC 141b or HCFC 225) in use of a flushing machine. Hereinbelow, such a method is referred to as a flushing method 1.

In the next, another method is disclosed in JP-A-7-83545. There is proposed, as shown in FIG. 13, a heat source equipment A for HFC, an indoor unit B for HFC, a first connection pipe C and a second connection pipe D are connected in step 100; HFC and a refrigerating machine oil for HFC are charged thereinto in Step 101; an air conditioner is operated for flushing in Step 102; the refrigerant and the refrigerating machine oil in the air conditioner are recovered and a new refrigerant and a new refrigerating machine oil are charged in Step 103; and flushing is repeated by a predetermined number of times by operating the air conditioner in Steps 104 and 105, wherein a flushing machine is not used. Hereinbelow, such a method is referred to as flushing method 2.

However, the conventional flushing method 1 had following problems.

In the first place, a flushing liquid to be used was HCFC, of which ozone layer destruction coefficient is not 0. Therefore, substitution of HCFC for HFC as a refrigerant of air conditioner was in contradiction to such a usage of HCFC. Particularly, HCFC141b has a large ozone destruction coefficient of 0.11, wherein a usage of HCFC141b was problematic.

In the second place, the flushing liquid to be used should have been completely safe in terms of combustibility and toxicity. HCFC141b is combustible and has low toxicity. HCFC225 is not combustible but has low toxicity.

In the third place, a boiling point of HCFC141b is so high as 32° C. and that of HCFC225 is so high as 51.1 through 56.1° C. When an outdoor air temperature was lower than this boiling point, especially in a winter season, the flushing liquid remained in the first connection pipe C and the second connection pipe D because the liquid was in an liquid state after flushing. Because the flushing liquid was HCFC containing an ingredient of chlorine, the refrigerating machine oil for HFC was deteriorated.

In the fourth place, the flushing liquid is necessary to be completely recovered in consideration of the environment. And, it is also required to re-flush by a high-temperature nitrogen gas or the like so as not to cause the third problem. Thus, flushing work took a labor hour.

In the conventional flushing method 2 mentioned in the above had the following problems.

In the first place, in an embodiment disclosed in JP-A-7-83545, it was necessary to repeat flushing by a HFC refrigerant by three times and the HFC refrigerant used for the steps of flushing operation included impurities. Accordingly, it was impossible to reuse the refrigerant after recovery. In other words, it was necessary to prepare a refrigerant of three times as much as the quantity of ordinarily charged refrigerant, wherein there were problems in the cost and the environment.

In the second place, the refrigerating machine oil was exchanged after the steps of flushing operation, it was necessary to prepare a refrigerating machine oil three times as much as the quantity of ordinarily charged refrigerating machine oil, wherein there were problems in the cost and the environment. Further, the refrigerating machine oil for HFC was an ester or an ether, both of which had high hygroscopicity, wherein it was necessary to control water content in a refrigerating machine oil to be exchanged. Further, because the refrigerating machine oil was filled by a human to washed the air conditioner, there was a danger that the oil was under-charged or over-charged, wherein there was a possibility that troubles would occur in succeeding operation. Such an over-charging may cause destruction of a portion for compressing and overheating of a motor by compression of oil, and such an under-charging may cause mal-lubrication.

SUMMARY OF THE INVENTION

It is an object of the present invention to solve the above-mentioned problems inherent in the conventional techniques, and to provide a refrigeration cycle device of which refrigerant is exchanged from a refrigerant having a problem in terms of environment protection used in a previously installed refrigeration cycle device to a refrigerant having no problem in terms of environment protection, to provide a method of exchanging the refrigerant, and to provide a method of operating the device.

According to a first aspect of the present invention, there is provided a refrigeration cycle device comprising a first refrigeration circuit for circulating a refrigerant from a compressor through a heat exchanger on a heat source equipment side, a flow rate adjuster, a heat exchanger on an application side, and an accumulator in a sequential manner to the compressor, further comprising an extraneous matter catching means for catching extraneous matters in the refrigerant provided between the heat exchanger on the heat source equipment side and the accumulator respectively of the first refrigeration circuit.

According to a second aspect of the present invention, there is provided a refrigeration cycle device comprising a first refrigeration circuit for circulating a refrigerant from a compressor through a heat exchanger on a heat source equipment side, a flow rate adjuster, a heat exchanger on an application side, and an accumulator in a sequential manner to the compressor, further comprising a first bypass path for bypassing a refrigeration circuit between the heat exchanger on the application side and the accumulator respectively of the first refrigeration circuit which includes an extraneous matter catching means for catching extraneous matters in the refrigerant.

According to a third aspect of the present invention, there is provided a refrigeration cycle device according to the second aspect of the invention, further comprising a second bypass path for bypassing a refrigeration circuit between the heat exchanger on the heat source equipment side and the flow rate adjuster respectively of the first refrigeration circuit, which includes a cooling means for the refrigerant, and a heating means for the refrigerant provided on an upstream side of the extraneous matter catching means in the first bypass path.

According to a fourth advantage of the present invention, there is provided a refrigeration cycle device according to the third aspect of the invention, further comprising a first flow controlling means provided on an upper stream side of the heating means in the first bypass path, and a second flow controlling means provided on a downstream side of the cooling means in the second bypass path.

According to a fifth advantage of the present invention, there is provided a refrigeration cycle device comprising a first refrigeration circuit for circulating a refrigerant from a compressor through a heat exchanger on a heat source equipment side, a flow rate adjuster, a heat source exchanger on an application side, and an accumulator in a sequential manner to the compressor, further comprising an oil separating means for separating an oil component of the refrigerant provided between the compressor and the heat exchanger on the heat source equipment side of the first refrigeration circuit.

According to a sixth aspect of the present invention, there is provided a refrigeration cycle device comprising a first refrigeration circuit for circulating a refrigerant from a compressor through a heat exchanger on a heat source equipment side, a flow rate adjuster, a heat source exchanger on an application side, and an accumulator in a sequential manner to the compressor, further comprising a third bypass path for bypassing a refrigeration circuit between the heat exchanger on the heat source equipment side and the flow rate adjuster of the first refrigeration circuit, which includes an oil separating means for separating an oil.

According to a seventh aspect of the present invention, there is provided a refrigeration cycle device according to any one of the first through the fourth aspects of the invention, further comprising an oil separating means for separating an oil component of the refrigerant provided between the compressor and the heat exchanger on the heat source equipment side of the first refrigeration circuit.

According to an eighth aspect of the present invention, there is provided a refrigeration cycle device according to the second aspect of the invention, further comprising a third bypass path for bypassing a refrigeration circuit between the heat exchanger on the heat source equipment side and the flow rate adjuster respectively of the first refrigeration circuit, which includes an oil separating means for separating an oil component of the refrigerant.

According to a ninth aspect of the present invention, there is provided a refrigeration cycle device according to the third aspect of the invention, further comprising an oil separating means for separating an oil component of the refrigerant provided on an upstream side of the cooling means in the second bypass path.

According to a tenth aspect of the present invention, there is provided a refrigeration cycle device comprising a first refrigeration circuit for circulating a refrigerant from a compressor through a heat exchanger on a heat source equipment side, a flow rate adjuster, a heat exchanger on an application side, and an accumulator in a sequential manner to the compressor, and a second refrigeration circuit for circulating the refrigerant from the compressor through the heat exchanger on the application side, the flow rate adjuster, the heat exchanger on the heat source equipment side, and the accumulator in a sequential manner to the compressor, further comprising an extraneous matter catching means for catching extraneous matters in the refrigerant provided between the heat exchanger on the application side and the accumulator respectively of the first refrigeration circuit and simultaneously between the heat exchanger on the heat source equipment side and the accumulator respectively of the second refrigeration circuit.

According to an eleventh aspect of the present invention, there is provided a refrigeration cycle device comprising a first refrigeration circuit for circulating a refrigerant from a compressor, a heat exchanger on a heat source equipment side, a flow rate adjuster, a heat exchanger on an application side, and an accumulator in a sequential manner to the compressor, and a second refrigeration circuit for circulating a refrigerant from the compressor, through the heat exchanger on the application side, the flow rate adjuster, the heat exchanger on the heat source equipment side, and the accumulator in a sequential manner to the compressor, further comprising a first bypass path for bypassing a refrigeration circuit between the heat exchanger on the application side and the accumulator respectively of the first refrigeration circuit and bypassing a refrigeration circuit between the flow rate adjuster and the heat exchanger on the heat source equipment side respectively of the second refrigeration circuit, which includes an extraneous matter catching means for catching extraneous matters in the refrigerant.

According to a twelfth advantage of the present invention, there is provided a refrigeration cycle device according to the eleventh aspect of the invention, further comprising a second bypass path for bypassing a refrigeration circuit between the heat exchanger on the heat source equipment side and the flow rate adjuster respectively of the first refrigeration circuit and bypassing a refrigeration circuit between the compressor and the heat exchanger on the application side of the second refrigeration circuit, which includes a cooling means for the refrigerant, and a heating means for the refrigerant provided on an upstream side of the extraneous matter catching means in the first bypass path.

According to a thirteenth aspect of the present invention, there is provided a refrigeration cycle device according to the twelfth aspect of the invention, further comprising a first flow controlling means provided on an upstream side of the heating means in the first bypass path and a second flow controlling means provided on a downstream side of the cooling means in the second bypass path.

According to a fourteenth aspect of the present invention, there is provided a first refrigeration circuit for circulating a refrigerant from a compressor through a heat exchanger on a heat source equipment side, a flow rate adjuster, a heat exchanger on an application side, and an accumulator in a sequential manner to the compressor and a second refrigeration circuit for circulating a refrigerant from the compressor, the heat exchanger on the application side, the flow rate adjuster, the heat exchanger on the heat source equipment side, and the accumulator in the sequential manner to the compressor, further comprising an oil separating means for separating an oil component of the refrigerant provided between the compressor and the heat exchanger on the heat source equipment side respectively of the first refrigeration circuit and between the compressor and the heat exchanger on the application side respectively of the second refrigeration circuit.

According to a fifteenth aspect of the present invention, there is provided a refrigeration cycle device comprising a first refrigeration circuit for circulating a refrigerant from a compressor through a heat exchanger on a heat source equipment side, a flow rate adjuster, a heat exchanger on an application side, and an accumulator in a sequential manner to the compressor and a second refrigeration circuit for circulating a refrigerant from the compressor through the heat exchanger on the application side, the flow rate adjuster, the heat exchanger on the heat source equipment side, and the accumulator in a sequential manner to the compressor, further comprising a third bypass path for bypassing a refrigeration circuit between the heat exchanger on the heat source equipment side and the flow rate adjuster respectively of the first refrigeration circuit and bypassing a refrigeration circuit between the compressor and the heat exchanger on the application side respectively of the second refrigeration circuit, which includes an oil separating means for separating an oil component of the refrigerant.

According to a sixteenth aspect of the present invention, there is provided a refrigeration cycle device according to any one of the tenth through the thirteenth aspects of the invention, further comprising an oil separating means for separating an oil component of the refrigerant provided between the compressor and the heat exchanger on the heat source equipment side respectively of the first refrigeration circuit and between the compressor and the heat exchanger on the application side respectively of the second refrigeration circuit.

According to a seventeenth aspect of the present invention, there is provided a refrigeration cycle device according to the twelfth aspect of the invention, further comprising an oil separating means for separating an oil component of the refrigerant provided between the compressor and the heat exchanger on the heat source equipment side respectively of the first refrigeration circuit and between the compressor and the cooling means respectively of the second refrigeration circuit.

According to an eighteenth aspect of the present invention, there is provided a refrigeration cycle device according to the eleventh aspect of the invention, further comprising a third bypass path for bypassing a refrigeration circuit between the heat exchanger on the heat source equipment side and the flow rate adjuster respectively of the first refrigeration circuit and bypassing a refrigeration circuit between the compressor and the heat exchanger on the application side respectively of the second refrigeration circuit, which includes an oil separating means for separating an oil component of the refrigerant.

According to a nineteenth aspect of the present invention, there is provided a refrigeration cycle device according to the twelfth aspect of the invention, further comprising an oil separating means for separating an oil component of the refrigerant provided on an upstream side of the cooling means in the second bypass path.

According to a twentieth aspect of the present invention, there is provided a refrigeration cycle device according to any one of the first through the fourth, the seventh through the thirteenth, and the sixteenth through the nineteenth aspects of the invention, further comprising a bypass path for indoor unit which can control bypassing of the flow rate adjuster and the heat exchanger on the application side.

According to a twenty-first aspect of the present invention, there is provided a refrigeration cycle device according to any one of the fifth through the ninth and the fourteenth through the nineteenth aspects of the invention, further comprising a circulation path for returning an oil component separated by the oil separating means to the accumulator on a downstream side of the extraneous matter catching means.

According to a twenty-second aspect of the present invention, there is provided a refrigeration cycle device according to any one of the seventh through the ninth and the sixteenth through the eighteenth aspects of the invention, further comprising a mineral oil injecting means for injecting a mineral oil to the refrigerant on a downstream side of the oil separating means in the second bypass path.

According to a twenty-third aspect of the present invention, there is provided a refrigeration cycle device according to any one of the seventh through the ninth and the sixteenth through the eighteenth aspects of the invention, further comprising a water injecting means for injecting water into the refrigerant on the downstream side of the oil separating means in the second bypass path.

According to a twenty-fourth aspect of the present invention, there is provided a refrigeration cycle device according to the twenty-third aspect of the invention, further comprising a moisture absorbing means for absorbing moisture in the refrigerant provided in the refrigeration circuit.

According to a twenty-fifth aspect of the present invention, there is provided a refrigeration cycle device according to any one of the first through the fourth, the seventh through the thirteenth, and the sixteenth through the eighteenth aspects of the invention, wherein the extraneous matter catching means separates extraneous matters in the refrigerant by reducing a flow rate of the refrigerant at a part of the refrigeration circuit.

According to a twenty-sixth aspect of the present invention, there is provided a refrigeration cycle device according to any one of the first through the fourth, the seventh through the thirteenth, and the sixteenth through the eighteenth aspects of the invention, wherein the extraneous matter catching means catches extraneous matters in the refrigerant by making the refrigerant pass through a mineral oil.

According to a twenty-seventh aspect of the present invention, there is provided a refrigeration cycle device according to the twenty-sixth aspect of the invention, wherein the extraneous matter catching means solves CFC or HCFC in the refrigerant by making the refrigerant pass through a mineral oil.

According to a twenty-eighth aspect of the present invention, there is provided a refrigeration cycle device according to any one of the first through the fourth, the seventh through the thirteenth, and the sixteenth through the nineteenth aspects of the invention, wherein the extraneous matter catching means catches extraneous matters in the refrigerant by making the refrigerant pass through a filter.

According to a twenty-ninth aspect of the present invention, there is provided a refrigeration cycle device according to any one of the first through the fourth, the seventh through the thirteenth, and the sixteenth through the nineteenth aspects of the invention, wherein the extraneous matter catching means catches chloride ions in the refrigerant by making the refrigerant pass through an ion exchange resin.

According to a thirtieth aspect of the present invention, there is provided a refrigeration cycle device according to any one of the second through the fourth, the sixth through the ninth, the eleventh through the thirteenth, and the fifteenth through the nineteenth of the invention, wherein the first bypass path, the second bypass path, and the third bypass path are detachably provided in the refrigeration circuit.

According to a thirty-first aspect of the present invention, there is provided a refrigeration cycle device according to any one of the first through the thirtieth aspects of the invention, wherein hydro fluoro carbon (HFC) is used as the refrigerant.

According to a thirty-second aspect of the present invention, there is provided a method of forming a refrigeration cycle device according to any one of the first through the thirty-first aspects of the invention having a first refrigeration circuit for circulating a refrigerant from a compressor through a heat exchanger on a heat source equipment side, a flow rate adjuster, a heat exchanger on an application side, and an accumulator in a sequential manner to the compressor and a second refrigeration circuit for circulating a refrigerant from the compressor, through the heat exchanger on the application side, the flow rate adjuster, the heat exchanger on the heat source equipment side, and the accumulator in a sequential manner to the compressor, which utilizes a first refrigerant, comprising substituting the compressor, the heat exchanger on the heat source equipment side, the flow rate adjuster, the heat exchanger on the application side and the accumulator for those utilizing a second refrigerant, and utilizing existing refrigerant piping connected to the flow rate adjuster and the heat exchanger on the application side.

According to a thirty-third aspect of the present invention, there is provided a method of forming a refrigeration cycle device according to the thirty-second aspect of the invention, wherein the first refrigerant is chloro fluoro carbon (CFC) or hydro chloro fluoro carbon (HCFC); and the second refrigerant is hydro fluoro carbon (HFC).

According to a thirty-fourth aspect of the present invention, there is provided a method of operating a refrigeration cycle device in the refrigeration cycle device according to any one of the second through the fourth, the seventh through the thirteenth, and the sixteenth through the thirty-first aspects of the invention, wherein the refrigerant is circulated through the first bypass path and extraneous matters in the refrigerant are caught by the extraneous matter catching means.

According to a thirty-fifth aspect of the present invention, there is provided a method of operating the refrigeration cycle device according to any one of the third, the fourth, the twelfth, and thirteenth aspects of the invention, wherein the refrigerant is heated to make it a gas phase by the heating means.

According to a thirty-sixth aspect of the present invention, there is provided a method of operating the refrigeration cycle device according to the thirty-fourth or the thirty-fifth aspect of the invention, wherein the refrigerant is circulated through the second bypass path and extraneous matters in the refrigerant are caught by the extraneous matter catching means.

According to a thirty-seventh aspect of the present invention, there is provided a method of operating the refrigeration cycle device according to the thirty-sixth aspect of the invention, wherein the refrigerant is cooled to make it a liquid phase or a gas-liquid two-phase state by the cooling means.

According to a thirty-eighth aspect of the present invention, there is provided a method for operating the refrigeration cycle device according to the thirty-sixth or the thirty-seventh aspect of the invention, wherein heat is exchanged between the heating means and the cooling means for heating and cooling these means.

According to a thirty-ninth aspect of the present invention, there is provided a method of operating the refrigeration cycle device according to the thirty-fourth through the thirty-eighth aspects of the invention, wherein the refrigerant is bypassed through the bypass path for indoor unit.

According to a fortieth aspect of the present invention, there is provided a method of operating the refrigeration cycle device according to any one of the second through the fourth, the seventh through the thirteenth, and the sixteenth through the thirty-first aspects of the invention, wherein after circulating the refrigerant through at least the first bypass path and catching extraneous matters in the refrigerant by the extraneous matter catching means, at least the first bypass path is closed and a refrigerant is circulated through the first refrigeration circuit or the second refrigeration circuit to conduct ordinary operation.

According to a forty-first aspect of the present invention, there is provided a method of operating the refrigeration cycle device according to any one of the thirty-fourth through the fortieth aspects of the invention, wherein hydro fluoro carbon (HFC) is used as the refrigerant.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4*a* is a graph showing a solubility curve between a mineral oil and CFC;

FIG. 4*b* is a graph showing a solubility curve between a mineral oil and HCFC;

DETAILED DESCRIPTION OF THE PREFERRED EMBODIMENTS

A detailed explanation will be given of preferred embodiment of the present invention in reference to FIGS. 1 through 13 as follows, wherein the same numerical references are used for the same or the similar portions and description of these portions is omitted.

Embodiment 1

Figure 1:
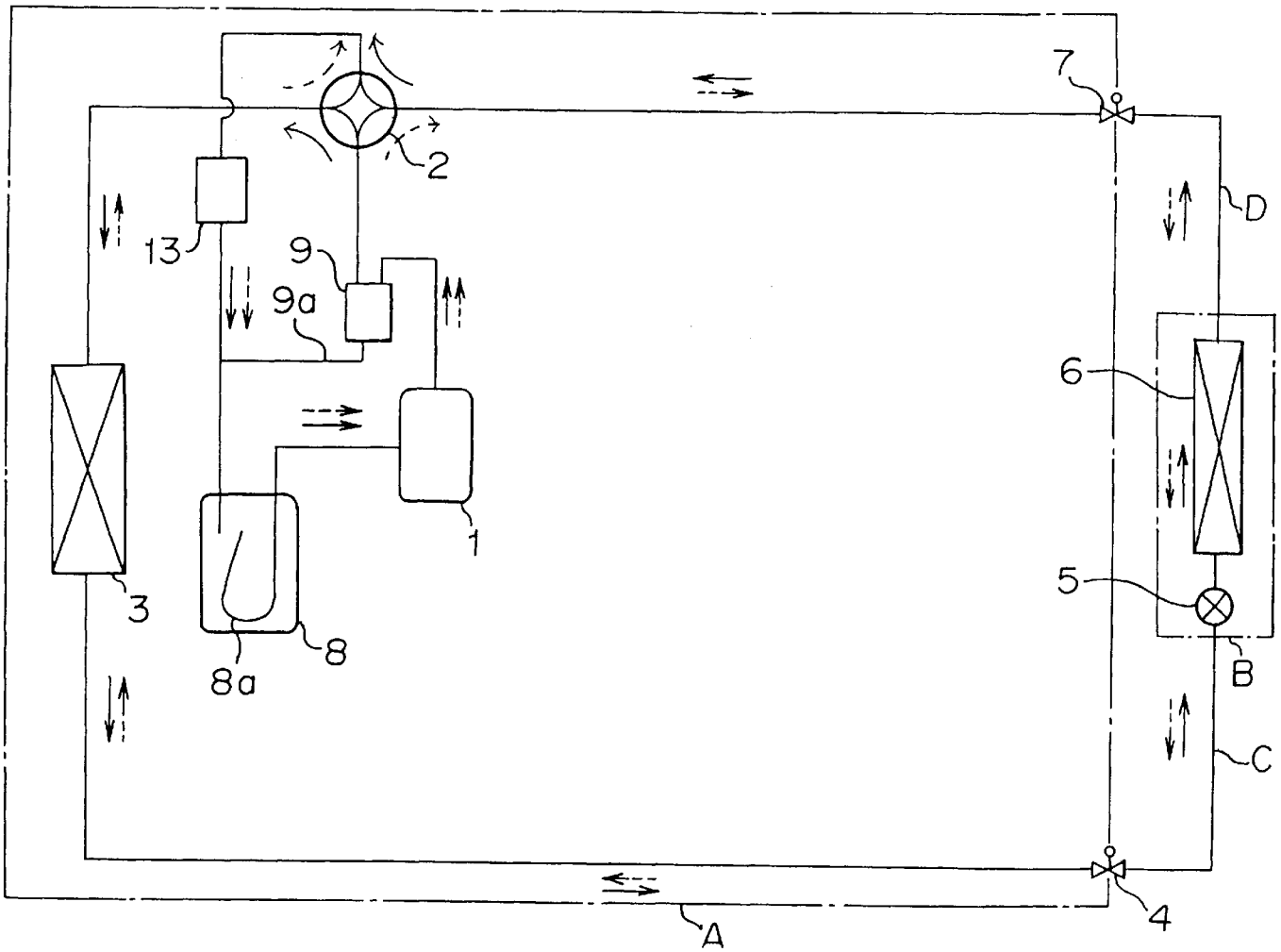
FIG. 1 schematically shows a refrigeration circuit of an air conditioner according to Embodiment 1 of the present invention as an example of a refrigeration cycle device.

FIG. 1 shows a refrigeration circuit of an air conditioner according to Embodiment 1 of the present invention as an example of a refrigeration cycle device.

In FIG. 1, reference A designates a heat source equipment in which a compressor 1, a four-way valve 2, a heat source equipment on a heat exchanger side 3, a first control valve 4, a second control valve 7, an accumulator 8, an oil separator 9 (i.e. a means for separating oil), and an extraneous matter catching means 13 are built.

The oil separator 9 is provided in a discharge pipe of the compressor 1 and separates a refrigerating machine oil discharged from the compressor 1 along with a refrigerant. The extraneous matter catching means 13 is provided between the four-way valve 2 and the accumulator 8. Numerical reference 9*a* designates a bypass path starting from a bottom portion of the oil separator 9 and arriving at a downstream side of an outlet of the extraneous matter catching means 13. An oil return hole 8*a* is provided in a lower portion of an effluent pipe in a U-like shape of the accumulator 8.

Reference B designates an indoor unit, in which a flow rate adjuster 5 or a flow rate control valve 5 and a heat exchanger on an application side 6 are provided.

Reference C designates a first connection pipe, one end of which is connected to the heat exchanger on the heat source equipment side 3 through the first control valve 4 and the other end of which is connected to the flow rate adjuster 5.

Reference D designates a second connection pipe, one end of which is connected to the four-way valve 2 through the second control valve 7 and the other end of which is connected to the heat exchanger on the application side 6.

The heat source equipment A and the indoor unit B are located apart from each other and connected through the first connection pipe C and the second connection pipe D, whereby a refrigeration circuit is formed.

In this, the air conditioner utilizes HFC as a refrigerant.

In the next, a procedure for exchanging an air conditioner utilizing CFC or HCFC in a case that the air conditioner is decrepit will be described. After recovering CFC or HCFC, the heat source equipment A and the indoor unit B are exchanged to those shown in FIG. 1. As for the first connection pipe C and the second connection pipe D, those in the air conditioner utilizing HCFC are reused. Because HFC is previously charged in the heat source equipment A, HFC is additionally charged while opening the first control valve 4 and the second control valve 7 after drawing a vacuum under a state that the first control valve 4 and the second control valve 7 are closed and the indoor unit B, the first connection pipe C, and the second connection pipe D are connected. Thereafter, ordinary air conditioning and flushing operation is conducted.

In the next, a detail of the ordinary air conditioning and flushing operation will be described in reference of FIG. 1. In FIG. 1, an arrow of solid line designates a flowing direction in cooling operation and an arrow of broken line designates a flow in heating operation.

At first, the cooling operation will be described. A gas refrigerant of high-temperature and high-pressure compressed by the compressor 1 is discharged from the compressor 1 along with a refrigerating machine oil for HFC and flows into the oil separator 9.

In the oil separator 9, the refrigerating machine oil for HFC is completely separated from the gas refrigerant. Only the gas refrigerant flows in the heat exchanger on the heat source equipment side 3 through the four-way valve 2 and is condensed and liquefied by exchanging heat with a heat source medium such as air and water. Thus condensed and liquefied refrigerant flows into the first connection pipe C through the first control valve 4.

A liquid refrigerant cleans CFC, HCFC, a mineral oil, and a deteriorated substance of mineral oil (hereinbelow, these are referred to as residual extraneous matters) which are remained in the first connection pipe C little by little and flows along with these matters when it flows through the first connection pipe C. Thereafter, the refrigerant flows into the flow rate adjuster 5, wherein it is depressurized to a low pressure to be in a low-pressure two-phase state. Thereafter, the refrigerant is evaporated and vaporized in the heat exchanger on the application side 6 by exchanging heat with a medium on the application side such as air.

Thus evaporated and vaporized refrigerant flows into the second connection pipe D along with the residual extraneous matters in the first connection pipe C. As for residual extraneous matters remaining in the second connection pipe, a part of residual extraneous matters attached to an inside of the pipe flows in a mist-like form because a refrigerant is gaseous. However, most extraneous matters in a liquid-like form can be securely cleaned within a flushing time longer than that for the first connection pipe C because these extraneous matters flow through the inside of the pipe such that these extraneous matters are pulled by the gas refrigerant at a flow rate lower than that of the gas refrigerant by shearing force generated in an interface between the gas and the liquid.

Thereafter, the gas refrigerant flows into the extraneous matter catching means 13 through the second control valve 7 and the four-way valve 2 along with the residual extraneous matters in the first connection pipe C and the residual extraneous matters in the second connection pipe D. The residual extraneous matters can be classified to three types of solid extraneous matters, liquid extraneous matters, and gaseous extraneous matters since a phase of the extraneous matter changes depending on their boiling points.

In the extraneous matter catching means 13, the solid extraneous matters and the liquid extraneous matters can be completely separated from the gas refrigerant and caught. A part of the gaseous extraneous matters is caught and the other part is not caught. Thereafter, the gas refrigerant returns to the compressor 1 through the accumulator 8 along with the other part of gaseous extraneous matters which have not been caught in the extraneous matter catching means 13.

Hereinbelow, a refrigeration circuit at a time of cooling operation, namely a refrigeration circuit starting from the compressor 1, passing through the heat exchanger on the heat source equipment side 3, the flow rate adjuster 5, the heat exchanger on the application side 6, and the accumulator 8 sequentially, and returning again to the compressor 1, is referred to as a first refrigeration circuit.

The refrigerating machine oil for HFC completely separated from the gas refrigerant in the oil separator 9 passes through the bypass path 9*a*, joins a main stream at a downstream side of the extraneous matter catching means 13, and returns to the compressor 1. Therefore, the oil is not mixed with a mineral oil remaining in the first connection pipe C and the second connection pipe D, and the refrigerating machine oil for HFC is incompatible with HFC and is not deteriorated by the mineral oil.

Further, the solid extraneous matters are not mixed with the refrigerating machine oil for HFC, wherein the refrigerating machine oil for HFC is not deteriorated. Further, although the gaseous extraneous matters are partly caught while the HFC refrigerant circulates through the refrigeration circuit by a cycle to pass through the extraneous matter catching means 13 by one time and therefore the refrigerating machine oil for HFC and the gaseous extraneous matters are mixed. However, deterioration of the refrigerating machine oil for HFC is a chemical reaction which does not abruptly proceed.

Figure 2:
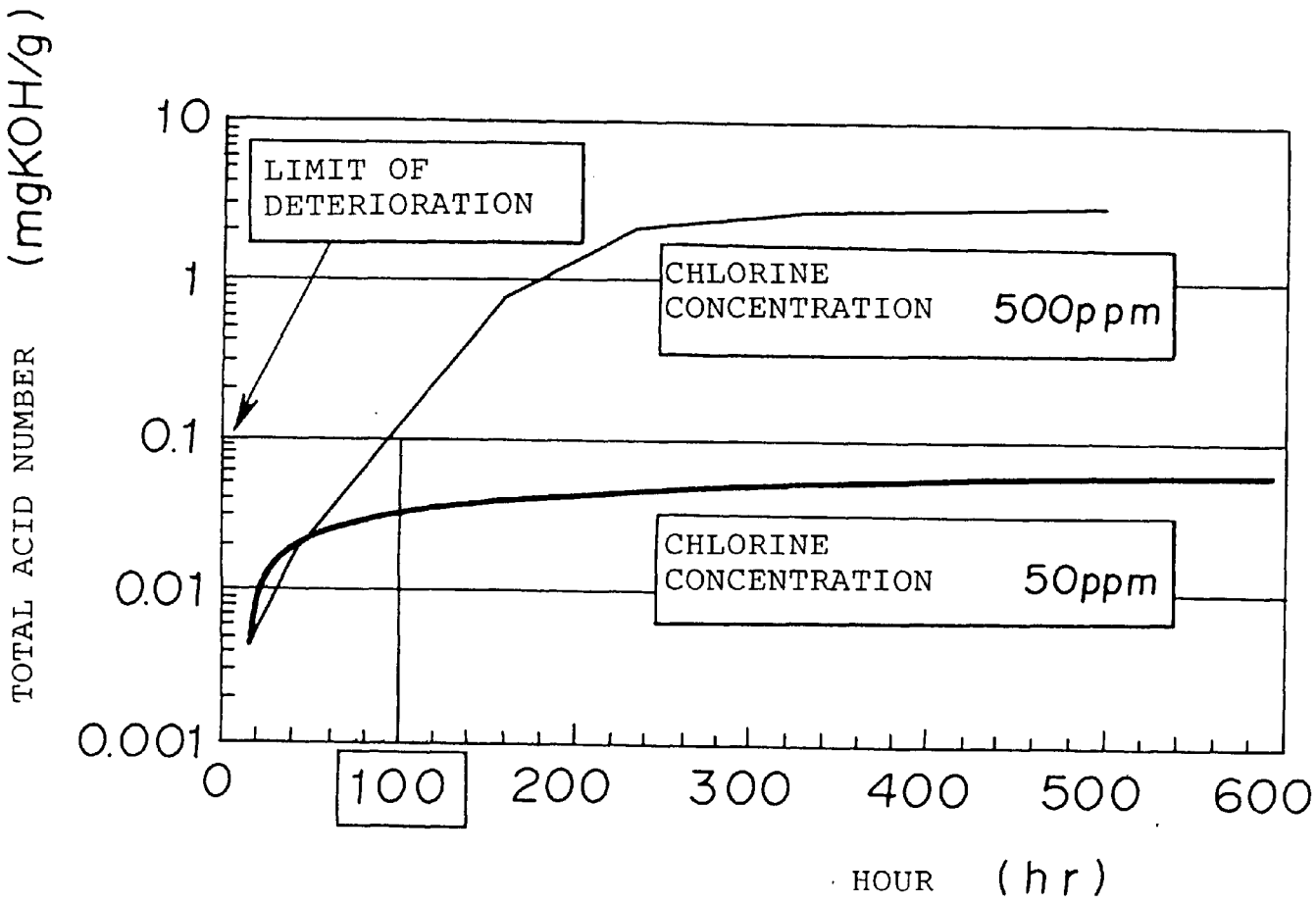
FIG. 2 is a graph showing deterioration of a refrigerating machine oil for HFC when it includes chlorine in a temperature of 175° C. in relation to a lapse of time.

An example is shown in FIG. 2. FIG. 2 is a diagram for showing a temporal variation of deterioration under temperature of 175° C. in a case that chlorine is mixed in a refrigerating machine oil for HFC, wherein an abscissa designates a time (hr) and an ordinate designates a total acid number (mgKOH/g).

The part of gaseous extraneous matters which was not caught while it has passed though the extraneous matter catching means 13 by one time further passes through the extraneous matter catching means 13 many times along with circulation of the HFC refrigerant. Therefore, the gaseous extraneous matters are caught in the extraneous matter catching means 13 before the refrigerating machine oil for HFC is deteriorated.

In the next, a flow in heating operation will be described. The gas refrigerant of high-temperature and high-pressure compressed by the compressor 1 is discharged from the compressor 1 along with the refrigerating machine oil for HFC and flows into the oil separator 9. The refrigerating machine oil for HFC is completely separated from the refrigerant, and only the gas refrigerant flows into the second connection pipe D through the four-way valve 2 and the second control valve 7.

As for the residual extraneous matters remaining in the second connection pipe, a part of the extraneous matters attached to an inside of the pipe flows in a mist-like form within the gas refrigerant because the refrigerant is gaseous. In this, because most of the residual extraneous matters of a liquid form flows through the inside of pipe in an annular shape at a flow rate lower than that of the gas refrigerant while being pulled by the gas refrigerant with shearing force generated on a interface between the gas and the liquid, the second connection pipe can be certainly cleaned within a flushing time longer than that for the first connection pipe C in the cooling operation.

Thereafter, the gas refrigerant flows into the heat exchanger on the application side 6 along with the residual extraneous matters in the second connection pipe D and is condensed and liquefied by exchanging heat with a medium on the application side such as air. Thus condensed and liquefied refrigerant flows into the flow rate adjuster 5 to be lowly depressurized to be in a low-pressure two-phase state, and flows into the first connection pipe C. Because of such a gas-liquid two-phase state, the refrigerant flows fast and the residual extraneous matters are cleaned by the liquid refrigerant at a higher rate than that for the first connection pipe at a time of cooling operation.

The refrigerant in a gas-liquid two-phase state passes through the first control valve 4 along with the residual extraneous matters washed out of the second connection pipe D and the first connection pipe C and is evaporated and vaporized in the heat exchanger on the heat source side 3 by exchanging heat with a heat source medium such as air and water. Thus evaporated and vaporized refrigerant flows into the extraneous matter catching means 13 through the four-way valve 2.

The residual extraneous matters can be classified into three types of solid extraneous matters, liquid extraneous matters, and gaseous extraneous matters since a phase of the residual extraneous matters is different depending on their boiling points. In the extraneous matter catching means 13, the solid extraneous matters and the liquid extraneous matters are completely separated from the gas refrigerant and caught. A part of the gaseous extraneous matters is caught and the other part is not caught.

Thereafter, the gas refrigerant returns to the compressor 1 through the accumulator 8 along with the other part of gaseous extraneous matters which were not caught in the extraneous matter catching means 13.

Hereinbelow, a refrigeration circuit at a time of heating operation, namely a refrigeration circuit starting from the compressor 1, sequentially passing through the heat exchanger on the application side 6, the flow rate adjuster 5, the heat exchanger on the heat source equipment side 3, and the accumulator 8, and returning again to the compressor 1, is referred to as a second refrigeration circuit.

Because the refrigerating machine oil for HFC completely separated from the gas refrigerant in the oil separator 9 returns to the compressor 1 after passing through the bypass path 9*a* and joining with a main flow at the downstream side of the extraneous matter catching means 13, the refrigerating machine oil is not mixed with a mineral oil remaining in the first connection pipe C and the second connection pipe D, is in compatible with HFC, and is not deteriorated by the mineral oil.

Further, because the solid extraneous matters is not mixed with the refrigerating machine oil for HFC, the refrigerating machine oil is not deteriorated.

Further, although the gaseous extraneous matters are mixed with the refrigerating machine oil as long as a part of the gaseous extraneous matters is caught while the HFC refrigerant circulates through the refrigeration circuit by one cycle and passes through the extraneous matter catching means 13 by one time, deterioration of the refrigerating machine oil for HFC does not abruptly proceed since such deterioration is a chemical reaction. An example is shown in FIG. 2. The other part of gaseous extraneous matters which was not caught while passing through the extraneous matter catching means 13 by one time repeatedly passes through the extraneous matter catching means 13 by many time along with the circulations of HFC refrigerant. Therefore, this is caught by the extraneous matter catching means 13 before the refrigerating machine oil for HFC is deteriorated.

Figure 3:
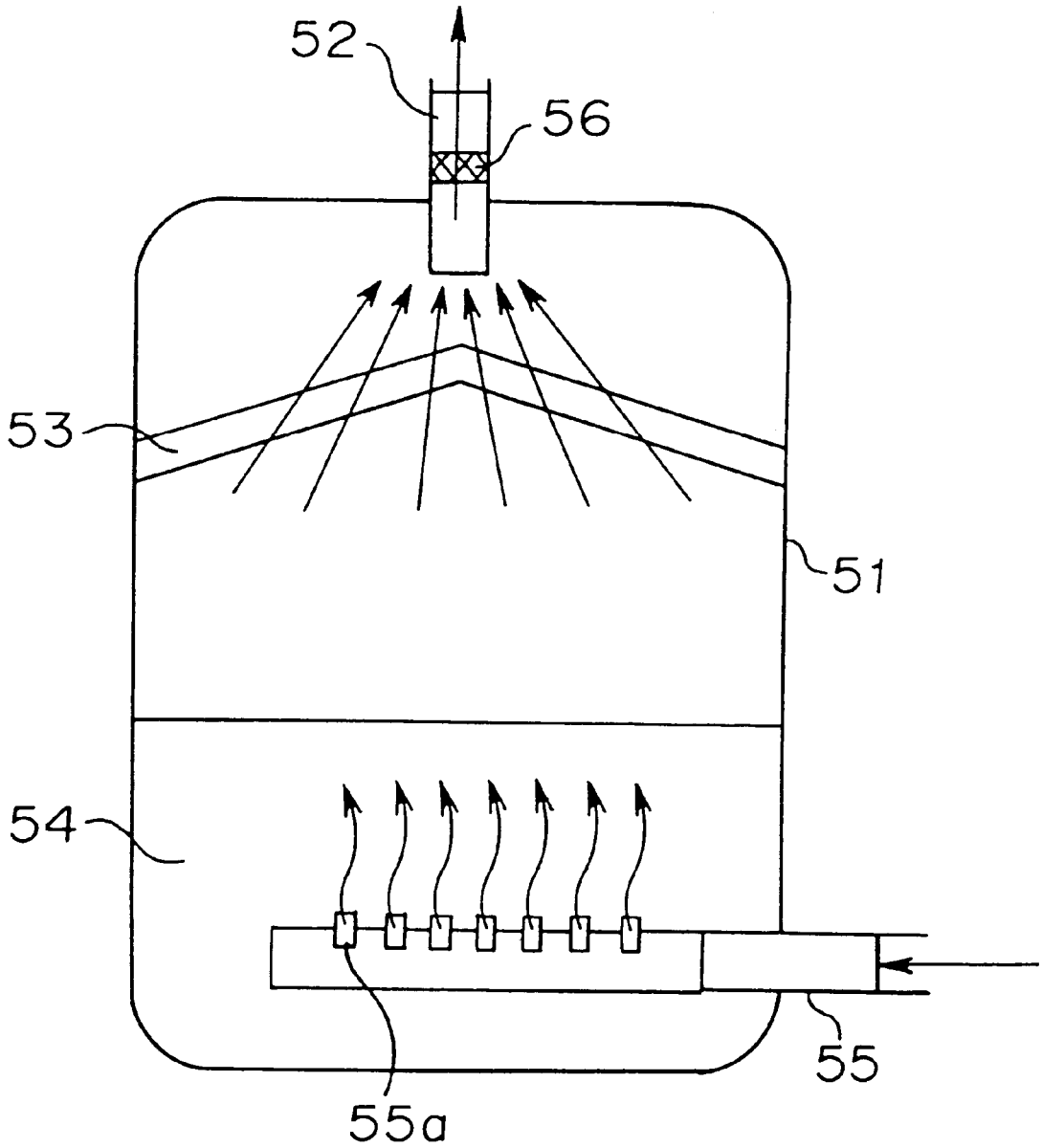
FIG. 3 schematically shows an example of an extraneous matter catching means 13.

In the next, an example of the extraneous matter catching means 13 will be described. FIG. 3 shows an example of the extraneous matter catching means 13. Numerical reference 51 designates a cylindrical container; numerical reference 52 designates an outflow pipe provided in an upper portion of the container 51; numerical reference 53 designates a filter provided in an inside of an upper portion of the container 51 having a cone side cross sectional view; numerical reference 54 designates a mineral oil precharged in the container 51; numerical reference 55 designates an inflow pipe provided in a side surface of a lower portion of the container 51; and numerical reference 55*a* designates a number of output holes provided in a side surface of a part of the outflow pipe 55 accommodated in the container 51.

For example, the filter 53 is formed by knitting fine lines or made of a sintered metal, wherein intervals of the meshes are from several microns to several dozens of microns, whereby solid extraneous matters larger than the intervals can not pass therethrough. Also, liquid extraneous matters in a mist-like form, which may exist a little in an upper space in the container 51, are caught by the filter 53 when passing therethrough and drop to a lower portion of the container 51 by flowing in a direction to side surface of the container by the gravity. Numerical reference 56 designates an ion exchange resin for catching chloride ions.

In FIG. 1, the outflow pipe 52 is connected to the accumulator 8 through the ion exchange resin 56, and the inflow pipe 55 is connected to the four-way valve 2.

A gas refrigerant flowing from the inflow pipe 55 passes through the output holes 55*a*, flows among the mineral oil 54 in a form like bubbles, passes through the filter 53 and the ion exchange resin 56, and flows out of the outflow pipe 52.

Solid extraneous matters flowed into the inflow pipe 55 along wit h the gas refrigerant lose their speed by resistance of the mineral oil 54 after flowing out from the output holes 55*a* into the mineral oil 54 and precipitate in a bottom portion of the container 51 by the gravity.

Even though the mineral oil 54 is not charged into the container 51, because the sectional area of the container 51 is larger than that of the inflow pipe 55 and therefore a flow rate of the refrigerant (gas) is lowered when it enters into the inside of container 51, the solid extraneous matters are separated from the refrigerant (gas) upon an effect of the gravity and precipitate in a lower portion of the container 51.

Further, even though a flow rate of gas is high in the mineral oil 54 and the solid extraneous matters are blown up to an upper portion of the mineral oil 54, the extraneous matters are caught by the filter 53.

The liquid extraneous matters flowed from the inflow pipe 55 along with the gas refrigerant flows into the mineral oil 54 from the output hole 55*a*. Thereafter, a speed of the liquid extraneous matters is decreased by resistance of the mineral oil 54, wherein a vapor-liquid separation occurs and the liquid extraneous matters accumulate in the mineral oil 54.

Even though the mineral oil 54 is not charged in the container, a sectional area of the container 51 is larger than that of the inflow pipe 55 and therefore a flow rate of the refrigerant (gas) is decreased in the inside of container 51. Accordingly, the liquid extraneous matters are separated from the refrigerant (gas) by an effect of the gravity and accumulate in a lower portion of the container 51.

Even though a flow rate of gas is high in the mineral oil 54 and the mineral oil is changed to a mist-like form by disturbance of a liquid level of the mineral oil 54 to follow a flow of gas refrigerant, the mineral oil is caught by the filter 53 and flows in a side surface direction of the container 51 by the gravity and drops to a lower portion of the container 51.

The gaseous extraneous matters flowed along-with the gas refrigerant from the inflow pipe 55 passes through the output holes 55*a*, the mineral oil 54 like foam, the filter 53, and the ion exchange resin 56 and flows out of the outflow pipe 52.

The CFC or HCFC, which is a principal component of the gaseous extraneous matters, dissolves in the mineral oil 54.

An example will be shown in FIGS. 4*a* and 4*b*. FIG. 4*a* shows solubility curves between a mineral oil and CFC. FIG. 4*b* shows solubility curves between a mineral oil and HCFC. In Figures, abscissas designate a temperature (° C.) and ordinates designate a pressure (kg/cm$^2$) of CFC or HCFC, wherein a concentration (wt %) of CFC or HCFC is used as a parameter in depicting the solubility curves.

The gaseous extraneous matters flowed along with the gaseous refrigerant from the inflow pipe 55 pass through the output holes 55*a* and are transformed to be like foam in the mineral oil 54, whereby a contact with the mineral oil 54 is extended and CFC or HCFC is further certainly dissolved in the mineral oil 54. However, since HFC does not dissolve in the mineral oil, the whole amount of HFC is discharged from the outflow pipe 52. Thus, the solid extraneous matters and the liquid extraneous matters are completely dissolved and caught in the inside of container 51. Further, CFC or HCFC, which is a principal component of the gaseous extraneous matters, is mostly dissolved and caught while passing through this portion.

A component of chlorine other than CFC, HCFC, or the like in the residual extraneous matters exists as chloride ions by dissolving in a small quantity of water in the refrigeration circuit. Therefore, such a component of chlorine is caught by the ion exchange resin 56 after passing through the ion exchange resin 5.

Figure 5:
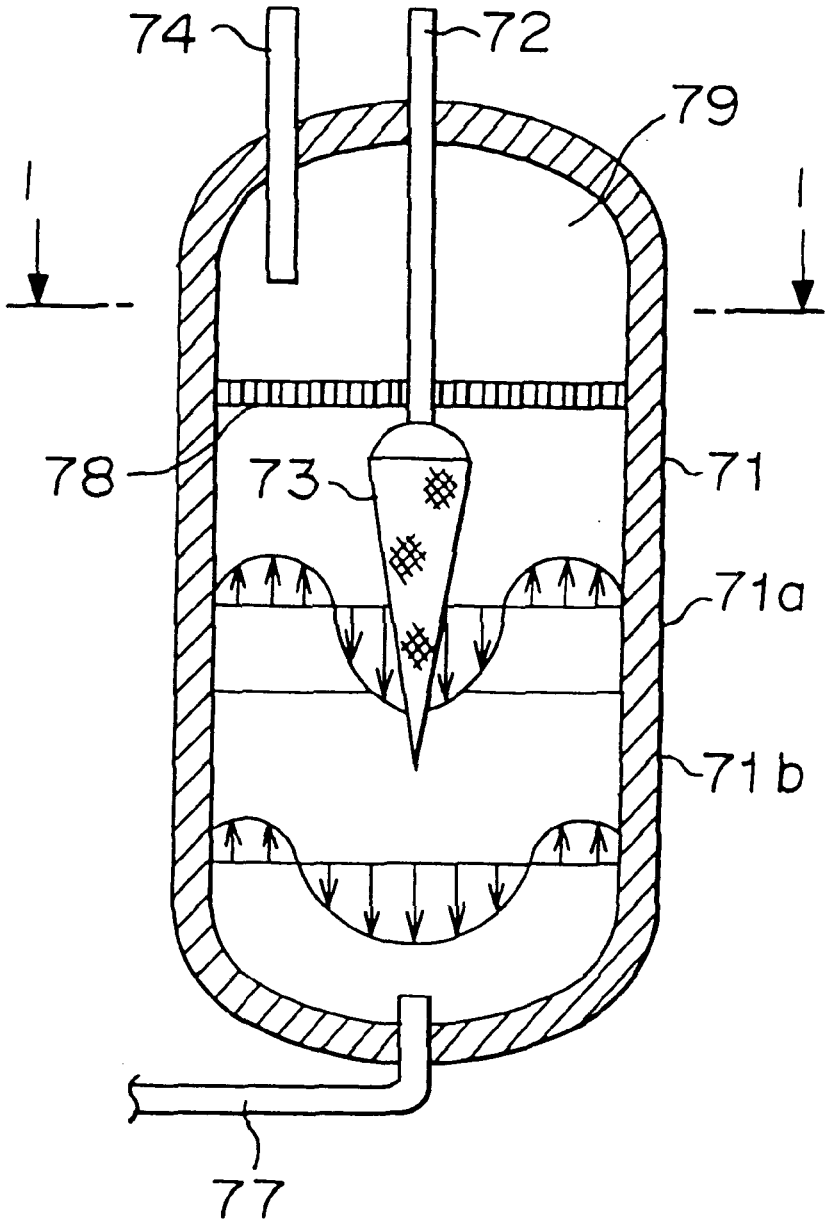
FIG. 5 schematically shows a structure of an oil separator.

In the next, the oil separator 9 will be described in detail. An example of a high performance oil separator is disclosed in Japanese Unexamined Utility Model Publication JP-A-5-19721. FIG. 5 shows an internal structure of such a high performance oil separator. Numerical reference 71 designates a sealed vessel having a cylindrical body composed of an upper shell 71*a* and a lower shell 71*b*; numerical reference 72 designates an inlet tube having a net-like piece in its tip end, which inlet tube penetrates through a substantially central portion of the upper shell 71*a* and protrudes from the vessel 71. Numerical reference 78 designates a rate averaging plate in a circular shape, which plate is provided above the net-like piece 73 and composed of such as a punching metal having a number of apertures; numerical reference 79 designates an upper space formed above the rate averaging plate 78 into which a refrigerant is to flow; numerical reference 74 designates an outlet tube one of which ends is in the space for introducing refrigerant 79; and numerical reference 77 designates an oil drain tube.

By connecting a plurality of such high performance oil separators in serial, it is possible to obtain an oil separator having a separation efficiency of 100%.

Figure 6:
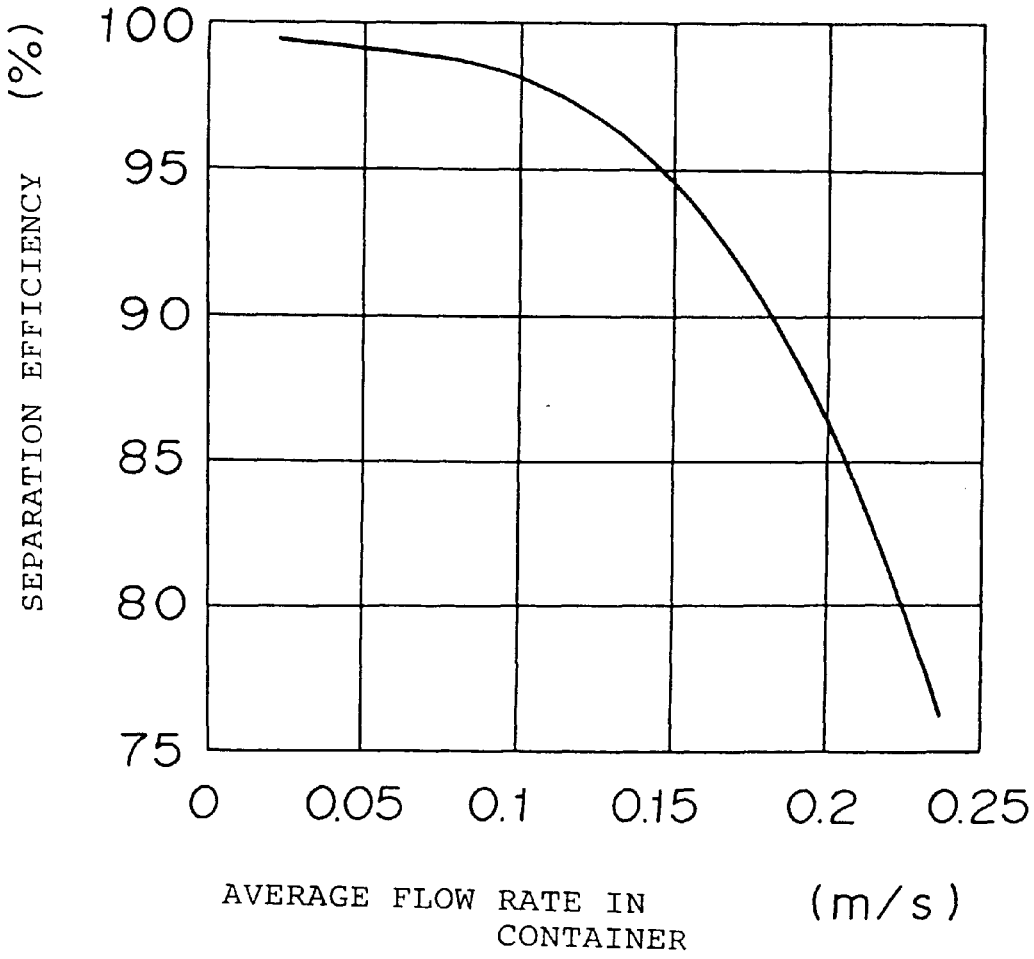
FIG. 6 is a graph showing a relationship between a flow rate of gas refrigerant and a separation efficiency in the oil separator.

In FIG. 6, a test result for showing relationship between a flow rate of gas refrigerant and a separation efficiency in the oil separator having a structure shown in FIG. 5. In FIG. 6, an abscissa designates an average flow rate (m/s) in the container and an ordinate designates a separation efficiency (%). Because a refrigerating machine oil discharged from a compressor 1 is generally 1.5 wt % or less with respect to an amount of refrigerant flow, the refrigerating machine oil on the secondary side of the first oil separator becomes 0.05 wt % or less with respect to an amount of refrigerant flow by adjusting an inner diameter of the first oil separator of serially connected oil separators such that a maximum flow rate becomes 0.13 m/s or less.

Under this ratio, because a gas-liquid two-phase flow of the gas refrigerant and the refrigerating machine oil has a form of spray flow, it is possible to completely separate the refrigerating machine oil by rendering an inner diameter of the second oil separator the same as that of the first oil separator and making meshes of the inlet tube very fine using such as a sintered metal. Thus, by combining modifications of dimensions of an equipped oil separator or of combining a plurality of such oil separators, it is possible to realize an oil separator having a separation efficiency of 100%. The oil separator 9 shown in FIG. 1 is constructed as described above.

As described, by newly exchanging for only a heat source equipment A, in which oil separator 9 and an extraneous matter catching means 13 are built in, and an indoor unit B, it is possible to substitute an aged air conditioner utilizing CFC or HCFC for an air conditioner utilizing new HFC without exchanging a first connection pipe C and a second connection pipe D. According to such a method, a flushing liquid for exclusive use (HCFC141b or HCFC225) is not used to clean not like the conventional flushing method 1 using a flushing machine when existing piping is reused, whereby there is not possibility of distracting an ozone layer, no combustibility, and no toxicity without need to deal with a remaining flushing liquid nor to recover the flushing liquid.

Further, not like the conventional flushing method 2, there is no need to repeat flushing operation by three times and to exchange a HFC refrigerant and a HFC refrigerating machine oil by three times. Therefore, a liquefied HFC and a refrigerating machine oil for HFC are as much as sufficient for one air conditioner, wherein it is advantageous to the cost and the environment. Further, it is not necessary to stock a refrigerating machine oil for exchange; and there is no danger of overcharging and undercharging a refrigerating machine oil. Also, there is no danger of incompatibility of refrigerating machine of HFC and no deterioration of refrigerating machine oil.

In Embodiment 1, an example that an indoor unit B is connected is described. However, it is needless to say that a similar effect thereto is obtainable by an air conditioner in which a plurality of indoor units B are connected in parallel or in serial.

Further, when a regenerative vessel containing ice or a regenerative vessel containing water (including hot water) is provided in serial to or in parallel to a heat exchanger on a heat source equipment side 3, a similar effect is obtainable. Further, in an air conditioner in which a plurality of heat source equipments A are connected in parallel, a similar effect thereto is clearly obtainable.

Meanwhile, not limited to an air conditioner, as long as products to which a refrigeration cycle of a vapor cycle refrigeration system is applied and in which an unit having a built-in heat exchanger on a heat source equipment side and an unit having a built-in heat exchanger on an application side are separately located, a similar effect is clearly obtainable.

Embodiment 2

Figure 7:
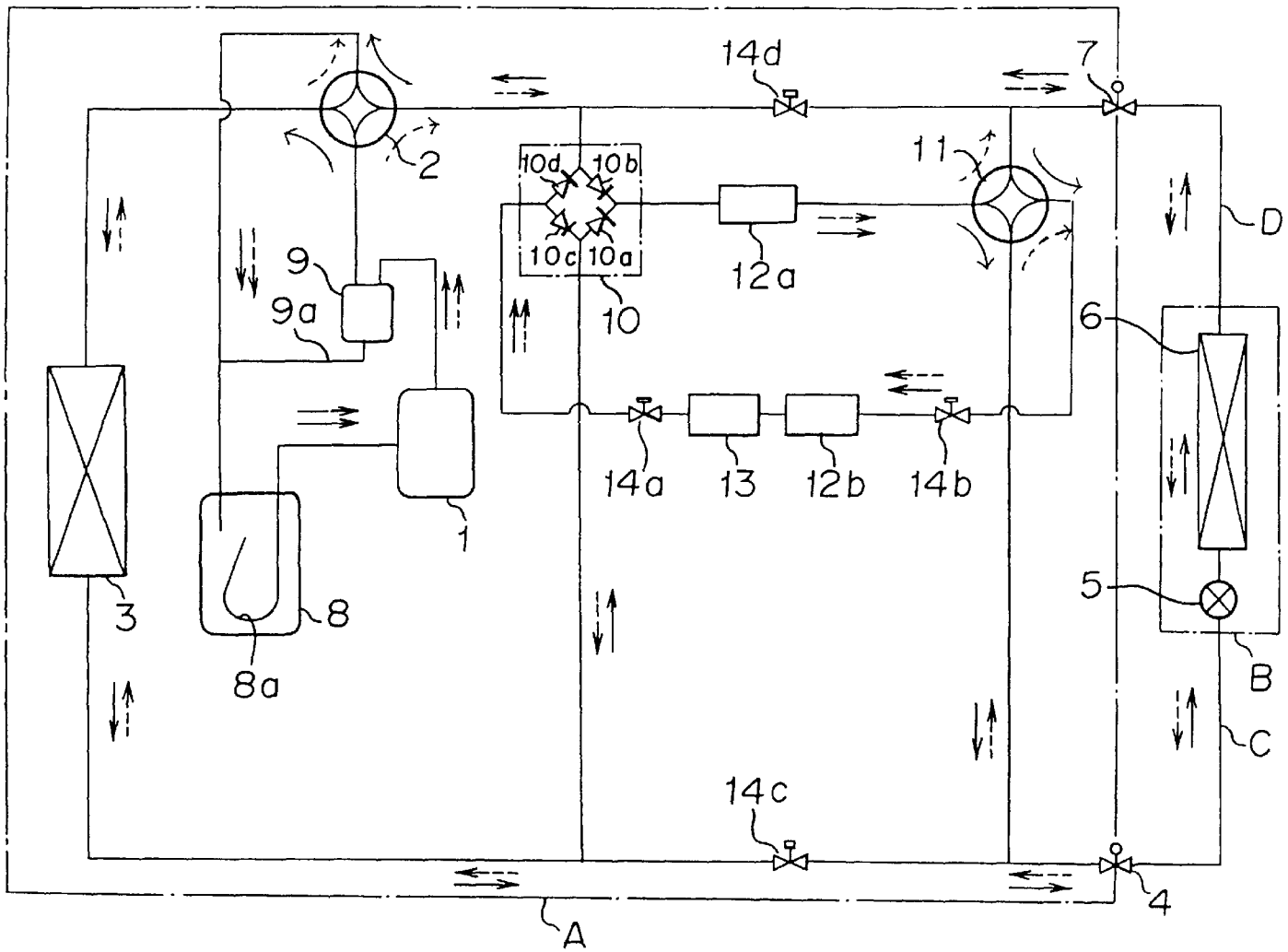
FIG. 7 schematically shows a refrigeration circuit of an air conditioner according to Embodiment 2 of the present invention as an example of a refrigeration cycle device.

FIG. 7 shows a refrigeration circuit of air conditioner as an example of a refrigeration cycle device according to Embodiment 2 of the present invention.

In FIG. 7, the references B through D, the numerical references 1 through 9, 8*a*, and 9*a* are the same as those in Embodiment 1. Therefore, detailed explanations thereof are omitted.

Numerical reference 12*a* designates a cooling device for cooling and liquefying a high-temperature high-pressure gas refrigerant; numerical reference 12*b* designates a heating means (i.e. a heating device) for vaporizing a low-pressure two-phase refrigerant; and numerical reference 13 designates an extraneous matter catching means (i.e. an extraneous matter catching device) provided in an outlet of the heating means 12*b* in serial. Numerical reference 14*a* designates a first electromagnetic valve provided in an outlet of the extraneous matter catching means 13; and numerical reference 14*b* designates a second electromagnetic valve provided in an inlet of the heating means 12*b*.

Numerical reference 10 designates a first switching valve, which switches connections of an outlet of the heat exchanger on a heat source equipment side 3 for cooling operation, an outlet of the four-way valve 2 for heating operation, an inlet of cooling means 12*a*, and an outlet of the electromagnetic valve 14*a* in response to operation modes. In other words, at a time of flushing operation for cooling, the outlet of the heat exchanger on the heat source equipment side 3 for cooling operation and the inlet of the cooling means 12*a* are connected and simultaneously the outlet of the electromagnetic valve 14*a* and the inlet of the four-way valve 2 for cooling operation (i.e. an outlet for heating operation) are connected. Further, at a time of flushing operation for heating, the outlet of the four-way valve 2 for heating operation and the inlet of cooling means 12*a* are connecting and simultaneously the outlet of the electromagnetic valve 14*a* and the inlet of the heat exchanger on the heat source equipment side 3 for heating operation (i.e. an outlet for cooling operation) are connected.

Numerical reference 11 designates a second switching valve, which connects an outlet of the cooling means 12*a* to the first control valve 4 at a time of flushing operation for cooling and ordinarily operation for cooling and connects the outlet of the cooling means 12*a* to the second control valve 7 at a time of flushing operation for heating and ordinary operation for heating, and connects an inlet of the electromagnetic valve 14*b* to the second control valve 7 at a time of flushing operation for cooling and connects the inlet of the electromagnetic valve 14*b* to the first control valve 4 at a time of flushing operation for heating.

Numerical reference 14*c* designates a third electromagnetic valve, which is provided in a middle of pipe for connecting a connecting portion between the first switching valve 10 and the heat exchanger on the heat source equipment side 3 and a connecting portion between the second switching valve 11 and the first control valve 4. Numerical reference 14*d* designates a fourth electromagnetic valve, which is provided in a middle of a pipe for connecting a connecting portion between the first switching valve 10 and the four-way valve 2 and a connecting portion between the second switching valve 11 and the second control valve 7.

The first switching valve 10 is composed of a check valve 10*a* of permitting a refrigerant flow from the outlet of the heat exchanger on the heat source equipment side 3 for cooling operation to the inlet of the cooling means 12*a* but not permitting the adverse flow, a check valve 10*b* of permitting a refrigerant flow from the outlet of the four-way valve 2 or heating operation to the inlet of the cooling means 12*a* but not permitting the adverse flow, a check valve 10*c* of permitting a refrigerant flow from the outlet of the first electromagnetic valve 14*a* to the outlet of the heat exchanger on the heat source equipment side 3 for cooling operation but not permitting the adverse flow, and a check valve 10*d* of permitting a refrigerant flow from the outlet of the first electromagnetic valve 14*a* to the outlet of the four-way valve 2 for heating operation but not permitting the adverse flow, wherein the switching valve is self-switchable depending on pressures of connections between the check valves without driven by any electrical signal.

A cool source of the cooling means 12*a* can be any one of air and water, and a heat source of the heating means 12*b* can be any one of air and water and can be activated by a heater. The cooling means 12*a* and the heating means 12*b* can be constituted such that a pipe on a high-temperature high-pressure side and a pipe on a low temperature low-pressure side, both of the pipes are interposed between the first switching valve 10 and the second switching valve 11, are thermally touched each other, for example an outer pipe of a double pipe is used for the pipe on a high-temperature high-pressure side and an inner pipe is used for the pipe on a low-temperature low-pressure side. In other words, heat is transferred between the heating means 12*b* and the cooling means 12*a*.

As described, the heat source equipment A includes the oil separator 9, the bypass path 9*a* for separated oil, the cooling means 12*a*, the heating means 12*b*, the extraneous matter catching means 13, the first switching valve 10, the second switching valve 11, the first electromagnetic valve 14*a*, the second electromagnetic valve 14*b*, the third electromagnetic valve 14*c*, and the fourth electromagnetic valve 14*d*. Hereinbelow, a refrigeration circuit including the heating means 12*b* and the extraneous matter catching means 13 is referred to as a first bypass path. And, a refrigeration circuit including the cooling means 12*a* is referred to as a second bypass path.

In this air conditioner, HFC is used as a refrigerant.

In the next, a procedure of exchanging an air conditioner when an air conditioner utilizing CFC or HCFC is decrepit will be described. After recovering CFC or HCFC, a heat source equipment A and an indoor unit B are exchanged for those shown in FIG. 7. A first connection pipe C and a second connection pipe D, both of the air conditioner utilizing HCFC, are reused.

Since HFC is prechanged in the heat source equipment A, a vacuum is drawn while closing the first control valve 4 and the second control valve 7 and connecting the indoor unit B, the first connection pipe C, and the second connection pipe D. Thereafter, the first control valve 4 and the second control valve 7 are opened to additionally charge HFC. Then, flushing operation is conducted and succeedingly ordinary air conditioning operation is performed.

Details of the flushing operation will be described in reference of FIG. 7. In FIG. 7, an arrow of solid line designates a flow of flushing operation for cooling and an arrow of broken line designates a flow of flushing operation for heating.

At first, the flushing operation for cooling will be described. A high-temperature high-pressure gas refrigerant compressed by a compressor 1 is discharged therefrom along with a refrigerating machine oil for HFC and flows into an oil separator 9. In this, the refrigerating machine oil for HFC is completely separated and only a gas refrigerant passes through a four-way valve 2 and flows into a heat exchanger on a heat source equipment side 3 to thereby condense and liquefy by exchanging heat with a heat source medium such as air and water to a certain extent.

Thus condensed and liquefied refrigerant to a certain extent flows into a cooling means 12*a* through a first switching valve 10, is completely condensed and liquefied in the cooling means 12*a*, and flows into the first connection pipe C through a second switching valve 11 and the first control valve 4.

When a liquid refrigerant of HFC flows through the first connection pipe C, it cleans CFC, HCFC, a mineral oil, and a deteriorated substance of mineral oil (hereinbelow, these are referred to as residual extraneous matters) which are remaining in the first connection pipe C little by little. Then, the residual extraneous matters flows along with the liquid refrigerant of HFC into a flow rate adjuster 5, in which the extraneous matters are depressurized to be a low-pressure two-phase state and evaporated and vaporized to a certain extent by exchanging heat with a medium on an application side such as air in a heat exchanger on an application side 6.

Thus evaporated and vaporized refrigerant in a gas-liquid two-phase state flows into the second connection pipe D along with the residual extraneous matters in the first connection pipe C. Residual extraneous matters remaining in the second connection pipe D is flushed at a higher rate than that for the first connection pipe C because the refrigerant passing therethrough is in an gas-liquid two-phase state and has a high flow rate sufficient to flush the residual extraneous matters along with the liquid refrigerant.

Thereafter, thus evaporated and vaporized gas-liquid two-phase refrigerant passes through the second control valve 7, the second switching valve 11, a second electromagnetic valve 14*b* along with the residual extraneous matters in the first connection pipe C and those in the second connection pipe D, flows into a heating means 12*b* so as to be completely evaporated and vaporized, and flows into an extraneous matter catching means 13. The residual extraneous matters have different phases depending on their boiling points, wherein these are classified into three type of solid extraneous matters, liquid extraneous matters, and gaseous extraneous matters. In the extraneous matter catching means 13, the solid extraneous matters and the liquid extraneous matters are completely separated from the gas refrigerant and caught.

A part of the gaseous extraneous matters is caught and the other part is not caught. Thereafter, the gas refrigerant returns to the compressor 1 along with the other part of gaseous extraneous matters which were not caught by the extraneous matter catching means 13 through the first electromagnetic valve 14, the first switching valve 10, a four-way valve 2, and an accumulator 8.

A refrigerating machine oil for HFC completely separated from the gaseous refrigerant in the oil separator 9 passes through a bypass path 9*a*, joins with a main flow on a downstream side of the extraneous matter catching means 13, and returns to the compressor 1. Therefore, the refrigerating machine oil is not mixed with a mineral oil remaining in the first connection pipe C or the second connection pipe D. The refrigerating machine oil for HFC is incompatible with respect to HFC and is not deteriorated by a mineral oil.

In addition, the solid extraneous matters are not mixed with the refrigerating machine oil for HFC and the refrigerating machine oil for HFC is not deteriorated. Further, although only a part of the gaseous extraneous matters is caught by the extraneous matters catching means 13 while passing through the extraneous matter catching means 13 by one time when a HFC refrigerant circulates the refrigeration circuit by one cycle and therefore the refrigerating machine oil for HFC is mixed with the gaseous extraneous matters, deterioration of refrigerating machine oil for HFC is a chemical reaction and does not abruptly proceed. Such an example will be shown in FIG. 2. Since a part of gaseous extraneous matters which was not caught while passing through the extraneous matter catching means 13 by one time passes through the extraneous matter catching means 13 along with circulations of the HFC refrigerant by many times, the extraneous matters are caught by the extraneous matter catching means 13 before deterioration of the refrigerating machine oil for HFC.

In the next, a flow in flushing operation for heating will be described. A high-temperature high-pressure gas refrigerant compressed by the compressor 1 is discharged from the compressor 1 along with the refrigerating machine oil for HFC and flows into the oil separator 9. In this, the refrigerating machine oil for HFC is completely separated and only the gas refrigerant flows into the cooling means 12*a* through the four-way valve 2 and the first switching valve 10.

In the cooling means, the gas refrigerant is cooled and is condensed and liquefied to a certain extent. Thus condensed and liquefied refrigerant to a certain extent flows into the second connection pipe D through the second switching valve 11 and the second control valve 7 in a gas-liquid two-phase state. The residual extraneous matters remaining in the second connection pipe is flushed along with the liquid refrigerant at a high rate than that for the first connection pipe C at a time of flushing operation for cooling because the refrigerant flowing through the second connection pipe has a high flow rate in a gas-liquid two-phase state.

Thereafter, thus condensed and liquefied refrigerant to a certain extent flows into the heat exchanger on the application side 6 and is completely condensed and liquefied by exchanging heat with a medium on the application side such as air.

The condensed and liquefied refrigerant flowed into the flow rate adjuster 5 is depressurized to a low pressure so as to be in a low-pressure two-phase state, and flows into the first connection pipe C. The residual extraneous matters are flushed along with the liquid refrigerant at a higher rate than that in the first connection pipe C at a time of flushing operation for cooling since the refrigerant is in a gas-liquid two-phase state in a high flow rate. The refrigerant in a gas-liquid two-phase state passes through the first control valve 4, the second switching valve 11, and the second electromagnetic valve 14*b* along with the residual extraneous matters flushed out of the second connection pipe D and the first connection pipe C, is heated by the heating means 12*b* to be evaporated and vaporized, and flows into the extraneous matter catching means 13.

The residual extraneous matters have different phases depending on their boiling points and a classified into three types of solid extraneous matters, liquid extraneous matters, and gaseous extraneous matters. In the extraneous matter catching means 13, the solid extraneous matters and the liquid extraneous matters are completely separated from the gas refrigerant and caught. A part of the gaseous extraneous matters is caught and the other part is not caught. Thereafter, the gas refrigerant flows into the heat exchanger on the heat source equipment side 3 through the first switching valve 10 and the four-way valve 2 along with the other part of the gaseous extraneous matters, which was not caught by the extraneous matter catching means 13, is passed through the heat exchanger on the heat source equipment side 3 without exchanging heat by stopping a fan and so on, and returns to the compressor 1 through the accumulator 8.

The refrigerating machine oil for HFC completely separated from the gas refrigerant by the oil separator 9 passes through the bypass path 9*a*, joins with the main flow on a downstream side of the extraneous matter catching means 13, and returns to the compressor 1. Therefore, the refrigerating machine oil does not mix in a mineral oil remaining in the first connection pipe C and the second connection pipe D, is incompatible with HFC, and is not deteriorated by the mineral oil.

Additionally, the solid extraneous matters are not mixed with the refrigerating machine oil for HFC, wherein the refrigerating machine oil for HFC is not deteriorated.

Additionally, although a part of the gaseous extraneous matters is caught while the HFC refrigerant circulates in a refrigeration circuit by one cycle and passes through the extraneous matter catching means 13 by one time and therefore the refrigerating machine oil for HFC and the gaseous extraneous matters are mixed, deterioration of the refrigerating machine oil for HFC does not abruptly proceed because it is a chemical reaction. Such an example is shown in FIG. 2.

The other part of the gaseous extraneous matters which is not caught while passing through the extraneous matter catching means 13 by one time passes through the extraneous matter catching means 13 along with circulations of the HFC refrigerant by many time. Therefore, the gaseous extraneous matters are caught by the extraneous matter catching means 13 before the refrigerating machine oil for HFC is deteriorated.

In this, the extraneous matter catching means 13 and the oil separator 9 are the same as those described in Embodiment 1 and explanations thereof are omitted.

Figure 8:
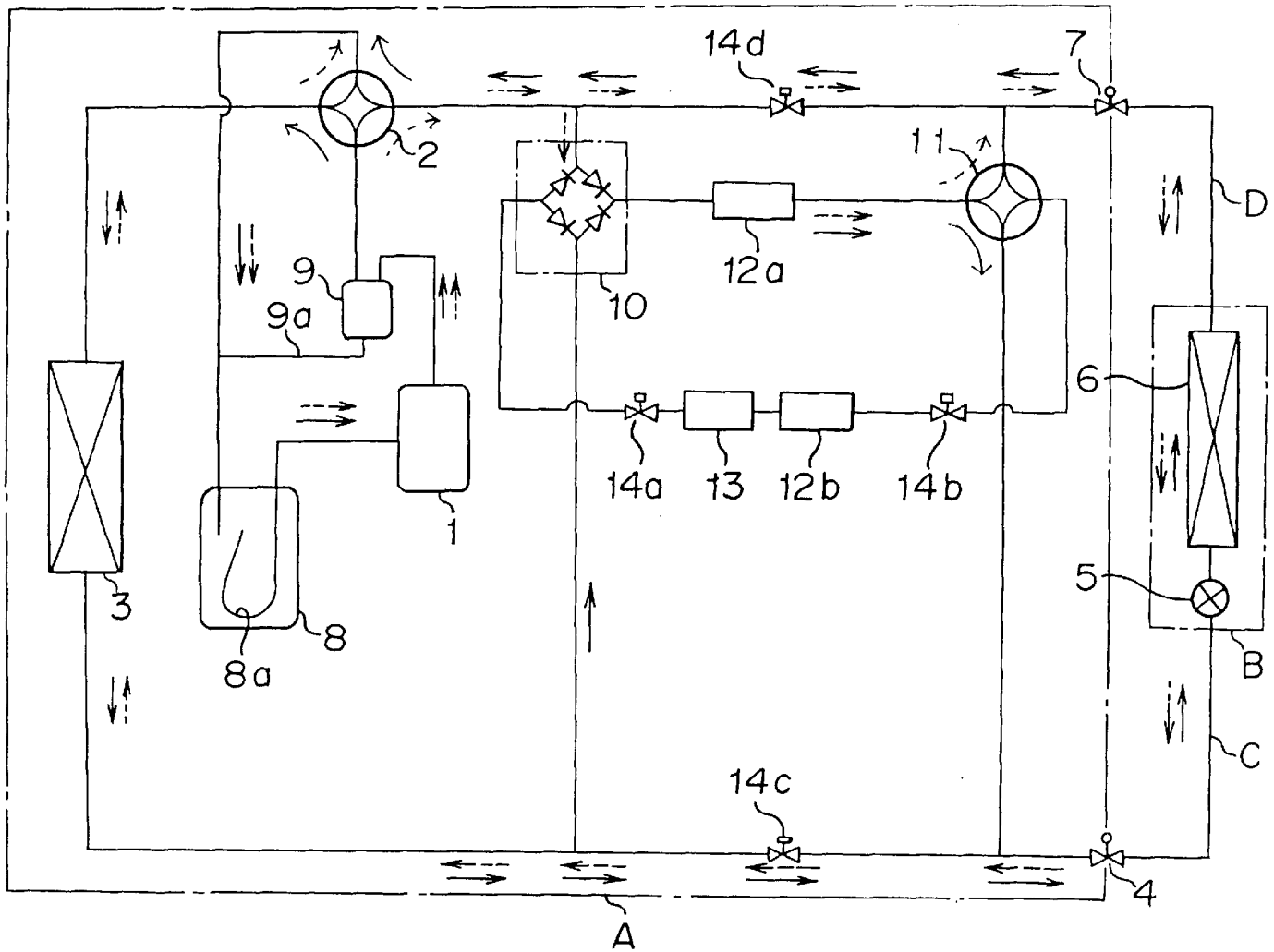
FIG. 8 schematically shows a state of ordinary air conditioning operation in the refrigeration cycle device according to Embodiment 2 of the present invention.

In the next, ordinary air conditioning operation will be described in reference of FIG. 8. In FIG. 8, an arrow of solid line designates a flow in ordinary operation for cooling and an arrow of broken line designates a flow in ordinary operation for heating.

At first, the ordinary operation for cooling will be described. A high-temperature high-pressure gas refrigerant compressed by the compressor 1 is discharged from the compressor 1 along with the refrigerating machine oil for HFC and flows into the oil separator 9. In the oil separator 9, the refrigerating machine oil for HFC is completely separated from the gas refrigerant and only the gas refrigerant flows into the heat exchanger on the heat source equipment side 3 through the four-way valve 2 and is condensed and liquefied by exchanging heat with a heat source medium such as air and water.

Most of the condensed and liquefied refrigerant passes through the third electromagnetic valve 14*c* and the rest of the refrigerant passes through the first switching valve 10, the cooling means 12*a*, and the second switching valve 11. Thereafter, these parts of the refrigerant join, flows into the first control valve 4, passes through the first connection pipe C, and flows into the flow rate adjuster 5. The refrigerant is depressurized to a low pressure to be a low-pressure two-phase state in the flow rate adjuster 5 and exchanges heat with a medium on the application side such as air so as to be evaporated and vaporized in the heat exchanger on the application side 6. Thus evaporated and vaporized refrigerant returns to the compressor 1 through the second connection pipe D, the second control valve 7, the fourth electromagnetic valve 14*d*, the four-way valve 2, and the accumulator 8.

The refrigerating machine oil for HFC which was completely separated from the gas refrigerant by the oil separator 9 passes through the bypass path 9*a*, joins to a main flow on a downstream side of the four-way valve 2, and returns to the compressor 1.

Because the first electromagnetic valve 14*a* and the second electromagnetic valve 14*b* are closed, the extraneous matter catching means 13 is isolated as a closed space, wherein the extraneous matters caught during the flushing operation do not return again to an operating circuit. Further, in comparison with Embodiment 1, a suction pressure loss of the compressor 1 is small and a drop of capability is small because it does not pass through the extraneous matter catching means 13.

In the next, a flow in ordinary operation for heating will be described. A high-temperature high-pressure gas refrigerant compressed by the compressor 1 is discharged from the compressor 1 along with the refrigerating machine oil for HFC and flows into the oil separator 9. In this, the refrigerating machine oil for HFC is completely separated therefrom and only the gas refrigerant passes through the four-way valve 2. Thereafter, most of the gas refrigerant passes through the fourth electromagnetic valve 14*d* and simultaneously the rest of the gas refrigerant passes through the first switching valve 10, the cooling means 12*a* and the second switching valve 11. These parts of gas refrigerant joins, flows into the second control valve 7, passes through the second connection pipe D and flows into the heat exchanger on the application side 6 so as to be completely condensed and liquefied by exchanging heat with a medium on the application side such as air.

The condensed and liquefied refrigerant flows into the flow rate adjuster 5 to thereby be lowly depressurized to be in a low-pressure two-phase state. Then, the refrigerant passes through the first connection pipe C, the first control valve 4, and the third electromagnetic valve 14*c*, flows into the heat exchanger on the heat source equipment side 3 and is evaporated and vaporized by exchanging heat with a heat source medium such as air and water. The evaporated and vaporized refrigerant returns to the compressor 1 through the four-way valve 2 and the accumulator 8.

The refrigerating machine oil for HFC completely separated from the gas refrigerant by the oil separator returns to the compressor 1 through the bypass path 9*a*. Because the first electromagnetic valve 14*a* and the second electromagnetic valve 14*b* are closed and therefore the extraneous matter catching means 13 is isolated as a closed space, extraneous matters caught during the flushing operation do not return again to an operating circuit. Meanwhile, in comparison with Embodiment 1, a suction pressure loss of the compressor 1 is small and a drop of capability is small because the extraneous matter catching means is not passed.

As described, by building the oil separator 9 and the extraneous matter catching means 13 in the heat source equipment A, it is possible to substitute an aged air conditioner utilizing CFC or HCFC for a new air conditioner with newly exchanging a heat source equipment A and an indoor unit B and without exchanging the first connection pipe C and the second connection pipe D. According to such a method of reusing existing piping, not like the conventional flushing method 1, it is not necessary to flush by a flushing liquid such as HCFC141b or HCFC225 for exclusive use in a flushing device, wherein there is no possibility to destruct the ozone layer; there is no combustibility nor toxicity; it is not necessary to care about a residual flushing liquid; and there is no need to recover a flushing liquid.

Further, not like the conventional flushing method 2, there is not need to exchange an HFC refrigerant or a refrigerating machine oil for HFC by three times while repeating flushing operation by three times. Therefore, quantities of HFC and the refrigerating machine oil respectively necessary for the flushing operation are as much as these for one air conditioner, whereby it is advantageous in terms of a cost and the environment. Further, it is not necessary to stock a refrigerating machine oil for exchange and no danger of over-supplying or under-supplying refrigerating machine oil at all. Further, there is no problems of incompatibility of refrigerating machine oil for HFC nor of deterioration of refrigerating machine oil.

By providing the first electromagnetic valve 14*a*, the second electromagnetic valve 14*b*, the third electromagnetic valve 14*c*, and the fourth electromagnetic valve 14*d*, the above-mentioned flushing effect is obtained by making a refrigerant path through the extraneous matter catching means 13 at a time of flushing operation and the extraneous matter catching means 13 is isolated as a closed space by closing the first electromagnetic valve 14*a* and the second electromagnetic valve 14*b* at a time of ordinary operation after the flushing operation, whereby extraneous matters caught during the flushing operation do not return again to an operating circuit. Further, in comparison with Embodiment 1, since the extraneous matter catching means 13 is not passed, a suction pressure loss of the compressor 1 is small and a drop of capability is small.

Further, by providing the cooling means 12*a*, the heating means 12*b*, the first switching valve 10, and the second switching valve 11, a liquid refrigerant or a gas-liquid two-phase refrigerant flows through the first connection pipe C and the second connection pipe D at a time of flushing operation regardless of cooling or heating, whereby a flushing effect is high and a flushing time is short in flushing residual extraneous matters.

Further, because it is possible to control a degree of exchanging heat by the cooling means 12*a* and the heating means 12*b*, substantially the same flushing operation can be performed under a predetermined condition regardless of an outdoor air temperature or an internal load, whereby an effect and a labor hour are made constant.

In Embodiment 2, an example that one indoor unit B is connected is described. However, a similar effect thereto is obtainable even in an air conditioner in which a plurality of indoor units B are connected in parallel or in serial.

Further, it is clear that a similar effect is obtainable even through regenerative vessels containing ice or regenerative vessels containing water (including hot water) are provided in serial or in parallel to the heat exchanger on the heat source equipment side 3.

Further, it is also clear that a similar effect is obtainable even in an air conditioner in which a plurality of heat source equipments A are connected in parallel.

Further, it is clear that a similar effect is obtainable in products of a vapor cycle refrigeration system to which a refrigeration cycle is technically applied as long as a unit in which a heat exchanger on a heat source equipment side is built and a unit in which a heat exchanger on an application side is built are separately located, even though the product is not an air conditioner.

Embodiment 3

Figure 9:
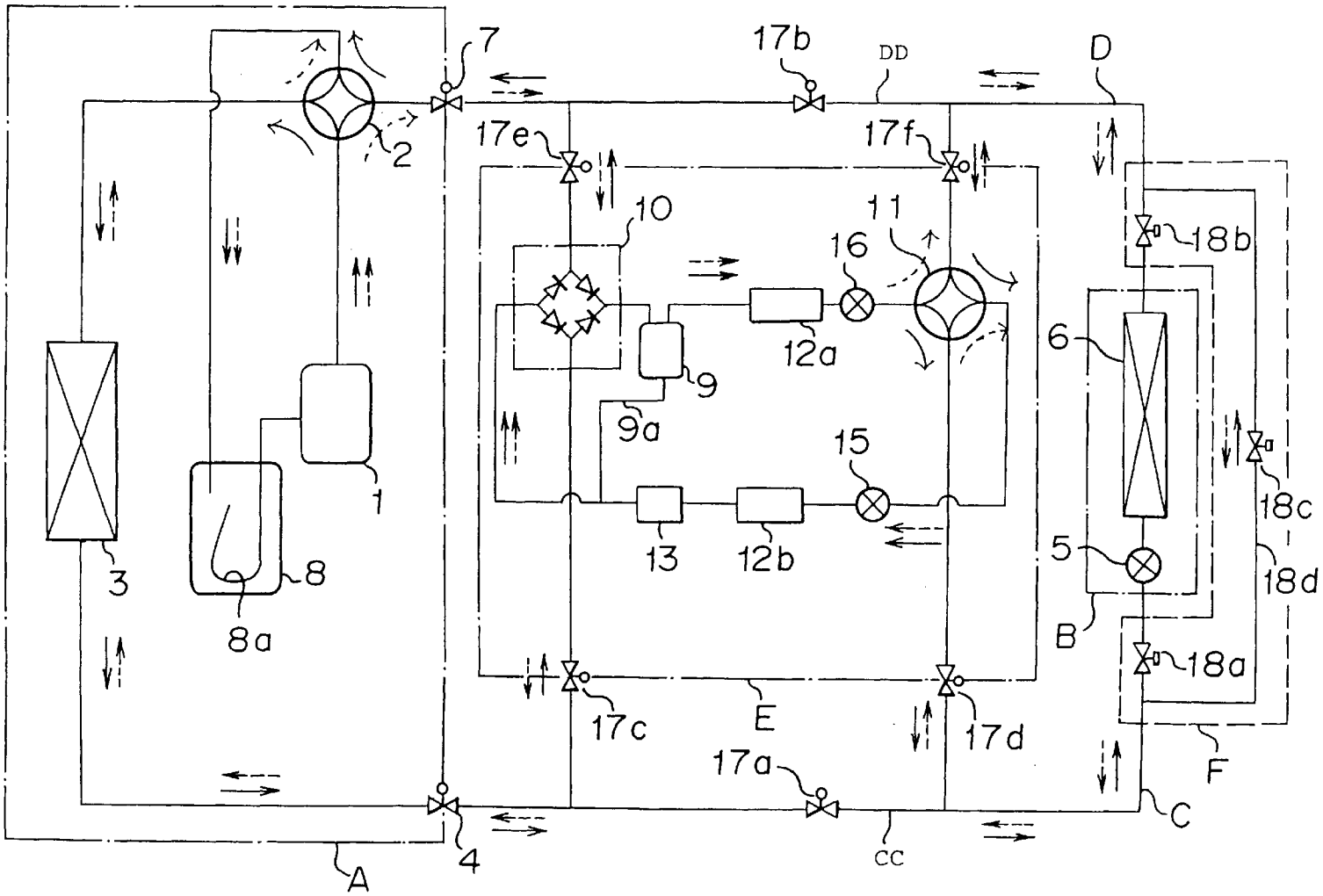
FIG. 9 schematically shows a refrigeration circuit of an air conditioner according to Embodiment 3 of the present invention as an example of a refrigeration cycle device.

FIG. 9 shows a refrigeration circuit of an air conditioner as an example of refrigeration cycle device according to Embodiment 3 of the present invention. In FIG. 9, the references B through D, the numerical references 1 through 8, and 8*a* designate respectively those described in Embodiment 1 and Embodiment 2 and detailed explanations are omitted. Further, the numerical references 10, 11, 12*a*, 12*b*, and 13 are similar to those described in Embodiment 2 and detailed explanations thereof are also omitted.

In FIG. 9, numerical reference 9 designates an oil separator, which is similar to those described in Embodiments 1 and 2 but it is different from at a point that it is provided between the first switching valve 10 and the cooling means 12*a*.

Further, numerical reference 9*a* designates a bypass path starting from a bottom portion of the oil separator 9 and returning to a downstream side of the extraneous matter catching means 13, which bypass path is similar to those described in Embodiments 1 and 2 but different from at a point that it returns between the extraneous matter catching means 13 and-the first switching valve 10.

Further, numerical reference 15 designates a first flow controlling means provided between the second switching valve 11 and the heating means 12*b*; and numerical reference 16 designates a second flow controlling means provided between the cooling means 12*a* and the second switching valve 11.

Reference CC designates a third connection pipe provided between the first connection pipe C and the first control valve 4; and reference DD designates a fourth connection pipe provided between the second connection pipe D and the second control valve 7.

Numerical reference 17*a* designates a third control valve provided in the third connection pipe CC; numerical reference 17*b* designates a fourth control valve provided in the fourth connection pipe DD; numerical reference 17*c* designates a fifth control valve provided between a portion of the third connection pipe CC connecting the first control valve 4 to the third control valve 17*a* and the first switching valve 10; numerical reference 17*d* designates a sixth control valve provided between a portion of the third connection pipe CC connecting the third control valve 17*a* to the first connection pipe C and the second switching valve 11; numerical reference 17*e* designates a seventh control valve provided between a portion of fourth connection pipe DD connecting the second control valve 7 to the fourth control valve 17*b* and the first switching valve 10; and numerical reference 17*f* designates an eighth control valve provided between a portion of the fourth connection pipe DD connecting the fourth control valve 17*b* to the second connection pipe D and the second switching valve 11.

Reference E designates a flushing machine constructed as described above, in which the oil separator 9, the bypass path 9*a*, the cooling means 12*a*, the heating means 12*b*, the extraneous matter catching means 13, the first switching valve 10, the second switching valve 11, the first flow controlling means 15, and the second flow controlling means 16 are built. The flushing machine is detachably connected to a complete air conditioner so that it can be disassembled from the fifth through eighth control valves 17*c* through 17*f*.

In Embodiment 3, a portion of a refrigeration circuit including the heating means 12*b* and the extraneous matter catching means 13 is referred to as the first bypass path as described in Embodiment 2. Additionally, a portion of refrigeration circuit including the cooling means 12*a* is referred to as the second bypass path irrespective of existence of the oil separator 9. Additionally, in consideration of a case that only the oil separator 9 exists without including the cooling means 12*a*, a portion of refrigeration circuit including the oil separator 9 is referred to as a third bypass path.

Further, numerical reference 18*a* designates a fifth electromagnetic valve provided between the first connection pipe C and the flow rate adjuster 5; numerical reference 18*b* designates a sixth electromagnetic valve provided between the second connection pipe D and the heat exchanger on the application side 6; and numerical reference 18*c* designates a seventh electromagnetic valve provided in a middle of a bypass path 18*d* for connecting a portion between the fifth electromagnetic valve 18*a* and the first connection pipe C and a portion between the sixth electromagnetic valve 18*b* and the second connection pipe D. Reference F designates an indoor bypass unit in which the fifth electromagnetic valve 18*a* through the seventh electromagnetic valve 18*c* are built.

This air conditioner utilizes HFC as a refrigerant.

In the next, a procedure of exchanging an air conditioner when an air conditioner utilizing CFC or HCFC is decrepit will be described, wherein CFC or HCFC is recovered and the heat source unit A and the indoor unit B are exchanged to those shown in FIG. 9. As for the first connection pipe C and the second connection pipe D, those used in the air conditioner utilizing HCFC are reused. The third connection pipe CC and the fourth connection pipe DD are newly laid. The washing machine E is connected to the third connection pipe CC through the fifth control valve 17*c* and the sixth control valve 17*d* and to the fourth connection pipe DD through the seventh control valve 17*e* and the eighth control valve 17*f*. The first connection pipe C and the second connection pipe D are connected to the indoor unit B through the indoor bypass unit F.

Because HFC is precharged into the heat source equipment A, a vacuum is drawn under a condition that the indoor unit B, the first connection pipe C, the second connection pipe D, the third connection pipe CC, the fourth connection pipe DD, the flushing machine E, and the indoor bypass unit F are connected to the first control valve 4 and the second control valve 7 is closed. Thereafter, the first control valve 4 and the second control valve 7 are opened and HFC is additionally charged.

Thereafter, the third control valve 17*a* and the fourth control valve 17*b* are closed; the fourth control valve 17*c* through the eighth control valve 17*f* are opened; the fifth electromagnetic valve 18*a* and the sixth electromagnetic valve 18*b* are opened; and the seventh electromagnetic valve 18*c* is opened to conduct flushing operation. Thereafter, the third control valve 17*a* and the fourth control valve 17*b* are opened; the fourth control valve 17*c* through the eighth control valve 17*f* are closed; the fifth electromagnetic valve 18*a* and the sixth electromagnetic valve 18*b* are opened; and the seventh electromagnetic valve 18*c* is closed to thereby conduct ordinary air conditioning operation.

In the next, a content of flushing operation will be described in reference of FIG. 9. In FIG. 9, an arrow of solid line designates a flow in flushing operation for cooling and an arrow of broken line designates a flow in flushing operation for heating.

At first, the flushing operation for cooling will be described. A high-temperature high-pressure gas refrigerant compressed by the compressor 1 is discharged from the compressor 1 along with the refrigerating machine oil for HFC, passes through the four-way valve 2, flows into the heat exchanger on the heat source equipment side 3, passes through the heat exchanger 3 without exchanging heat with a heat source medium such as air and water, and flows into the oil separator 9 through the first control valve 4, the fifth control valve 17*c*, and the first switching valve 10.

In the oil separator 9, the refrigerating machine oil for HFC is completely separated from the gas refrigerant and only the gas refrigerant flows into the cooling means 12*a*, is condensed and liquefied therein, and is depressurized a little in the second flow controlling means 16 to thereby be in a gas-liquid two-phase state. This gas refrigerant in a gas-liquid two-phase state flows into the first connection pipe C through the second switching valve 11 and the sixth control valve 17*d*.

When the gas-liquid two-phase refrigerant of HFC flows through the first connection pipe C, CFC, HCFC, a mineral oil, and a deteriorated substance of mineral oil (hereinbelow, referred to as residual extraneous matters) remaining in the first connection pipe C are flushed relatively quickly because of its state of gas-liquid two-phase. The residual extraneous matters flows along with the gas-liquid two-phase refrigerant of HFC, passes through the seventh electromagnetic valve 18*c*, and flows into the second connection pipe D along with the residual extraneous matters in the connection pipe C.

The residual extraneous matters remaining in the second connection pipe D flows fast because a refrigerant passing therethrough in a gas-liquid two-phase state, and are flushed accompanied by a liquid refrigerant, whereby the extraneous matters are flushed at a relatively high rate. Thereafter, the refrigerant in a gas-liquid two-phase state passes through the eighth control valve 17*f* and the second switching valve 11 along with the extraneous matters in the first connection pipe C and the extraneous matters in the second connection pipe D, is depressurized to a low pressure by the first flow controlling means 15, flows into the heating means 12*b* to be evaporated and vaporized, and flows into the extraneous matter catching means 13.

The extraneous matters have various phases in accordance with a difference of boiling points, by which classified to three kinds of solid extraneous matters, liquid extraneous matters, and gaseous extraneous matters. In the extraneous matter catching means 13, the solid extraneous matters and the liquid extraneous matters are completely separated from the gas refrigerant and caught. A part of the gaseous extraneous matters is caught and the other part is not caught.

Thereafter, the gas refrigerant return to the compressor 1 along with the other part of the gaseous extraneous matters which was not caught by the extraneous matter catching means 13 through the first switching valve 10, the seventh control valve 17*e*, the second control valve 7, the four-way valve 2, and the accumulator 8.

The refrigerating machine oil for HFC completely separated from the gas refrigerant by the oil separator passes through the bypass path 9*a*, joins to a main flow on a downstream side of the extraneous matter catching means 13, and returns to the compressor 1, whereby the refrigerating machine oil is not mixed with a mineral oil remaining in the first connection pipe C and the second connection pipe D, is incompatible with HFC, and is not deteriorated by a mineral oil.

Further, the solid extraneous matters are not mixed with the refrigerating machine oil for HFC and therefore the refrigerating machine oil for HFC is not deteriorated.

Further, although a part of the gaseous extraneous matters is caught while the HFC refrigerant circulates in a refrigeration circuit by one cycle and passes through the extraneous matter catching means 13 by one time, and therefore the refrigerating machine oil for HFC and the gaseous extraneous matters are mixed. However, deterioration of the refrigerating machine oil for HFC does not abruptly proceed because it is a chemical reaction. Such an example is shown in FIG. 2. The other part of gaseous extraneous matters which was not caught while passing through the extraneous matter catching means 13 by one time passes through the extraneous matter catching means 13 by many times along with circulation of the HFC refrigerant. Therefore, it can be caught by the extraneous matter catching means 13 before the refrigerating machine oil for HFC is deteriorated.

In the next, a flow in flushing operation for heating will be described. A high-temperature high-pressure gas refrigerant compressed by the compressor 1 is discharged from the compressor 1 along with the refrigerating machine oil for HFC and flows into the oil separator 9 through the four-way valve 2, the second control valve 7, the seventh control valve 17*e*, and the first switching valve 10. In the oil separator 9, the refrigerating machine oil for HFC is completely separated from the refrigerant and only the gas refrigerant flows into the cooling means 12*a*, in which the gas refrigerant is cooled, condensed and liquefied.

The condensed and liquefied liquid refrigerant is depressurized a little by the second flow controlling means 16 to be in a gas-liquid two-phase state and flows into the second connection pipe D through the second switching valve 11 and the eighth control valve 17*f*. The extraneous matters remaining in the second connection pipe flows fast because a refrigerant passing therethrough is in a gas-liquid two-phase state and are flushed along with a liquid refrigerant at a relatively high rate.

Thereafter, the gas-liquid two-phase refrigerant flows through the seventh electromagnetic valve 18*c* along with the residual extraneous matters in the second connection pipe D and flows into the first connection pipe C. In this, the extraneous matters flows fast because the refrigerant is in a gas-liquid two-phase state and are flushed accompanied by the liquid refrigerant at a relatively high rate.

The refrigerant in a gas-liquid two-phase state passes through the sixth control valve 17*d* and the second switching valve 11 along with the extraneous matters flushed out of the second connection pipe D and the first connection pipe C, is depressurized to a low pressure by the first flow controlling means 15, flows into the heating means 12*b* to be evaporated and vaporized, and flows into the extraneous matter catching means 13. The residual extraneous matters have various phases in accordance with the difference of boiling points and are classified to three types of solid extraneous matters, liquid extraneous matters, and the gaseous extraneous matters.

In the extraneous matter catching means 13, the solid extraneous matters and the liquid extraneous matters are completely separated from the gas refrigerant and caught. A part of the gaseous extraneous matters is caught and the other part is not caught. Thereafter, the gas refrigerant passes through the first switching valve 10 and the fifth control valve 17*c* along with the other part of gaseous extraneous matters which were not caught by the extraneous matter catching means 13, flows into the heat exchanger on the heat source side 3, passes therethrough without exchanging heat by stopping a fan and so on, and returns to the compressor 1 through the accumulator 8.

The refrigerating machine oil for HFC completely separated from the gas refrigerant by the oil separator 9 passes through the bypass path 9*a*, joins to a main flow on a down stream side of the extraneous matter catching means 13, and returns to the compressor 1, whereby the refrigerating machine oil is not mixed with a mineral oil remaining in the first connection pipe C and the second connection pipe D, is incompatible with HFC, and is not deteriorated by a mineral oil.

Further, the solid extraneous matters are not mixed with the refrigerating machine oil for HFC and the refrigerating machine oil for HFC is not deteriorated.

Further a part of the gaseous extraneous matters is caught while the HFC refrigerant circulates in a refrigeration circuit by one cycle and passes through the extraneous matter catching means 13 by one time and therefore the refrigerating machine oil for HFC and the gaseous extraneous matters are mixed, deterioration of refrigerating machine oil for HFC does not abruptly proceed because it is a chemical reaction. Such an example is shown in FIG. 2. The other part of the gaseous extraneous matters which was not caught while passing through the extraneous matter catching means 13 by one time passes through the extraneous matter catching means 13 by many times along with the circulation of the HFC refrigerant. Therefore, the extraneous matters can be caught by the extraneous matter catching means 13 before the refrigerating machine oil for HFC is deteriorated.

The extraneous matter catching means 13 and the oil separator 9 are the same as those described in Embodiment 1 and explanations of these are omitted.

Figure 10:
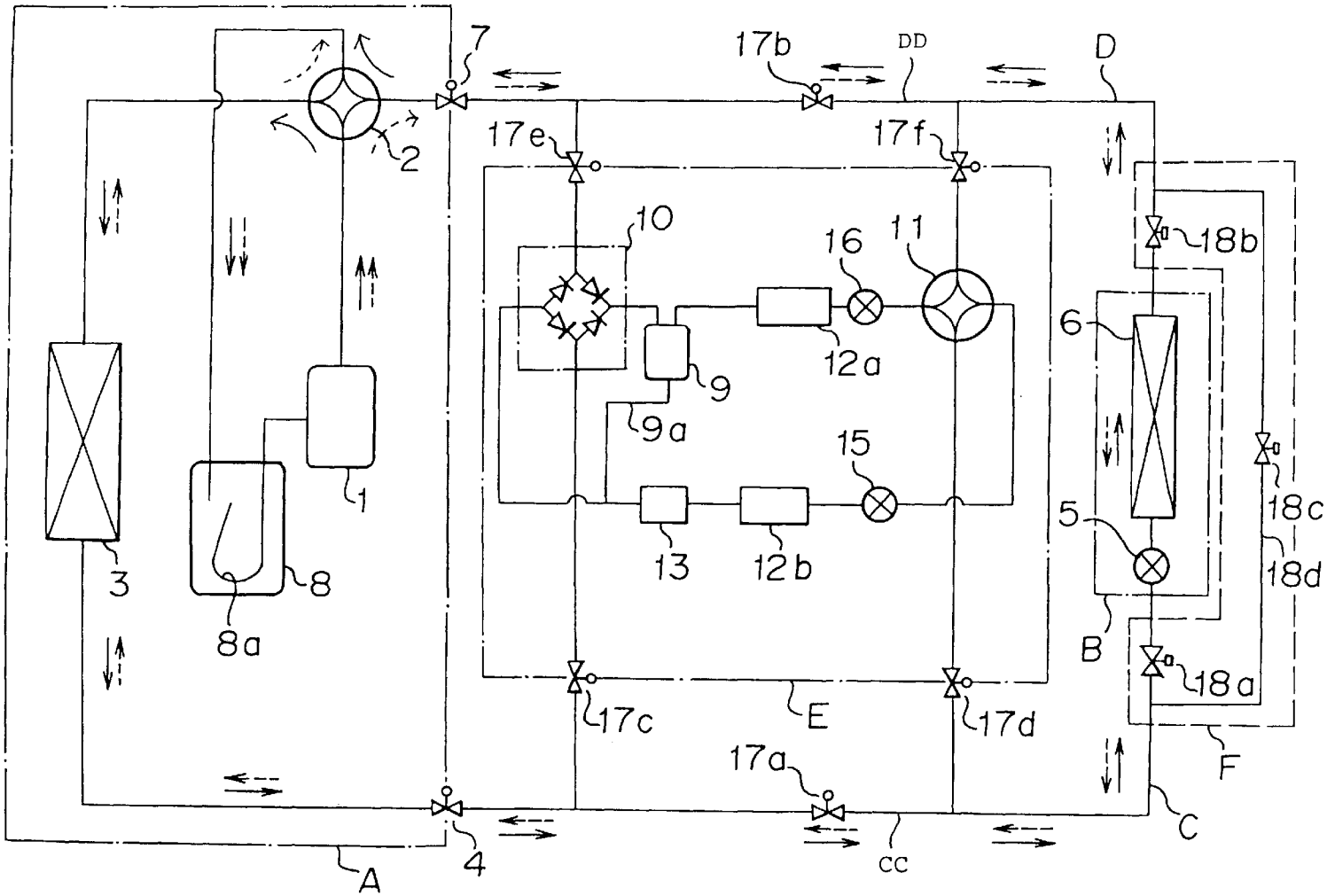
FIG. 10 schematically shows ordinary air conditioning operation in the refrigeration cycle device according to Embodiment 3 of the present invention.
Figure 11:
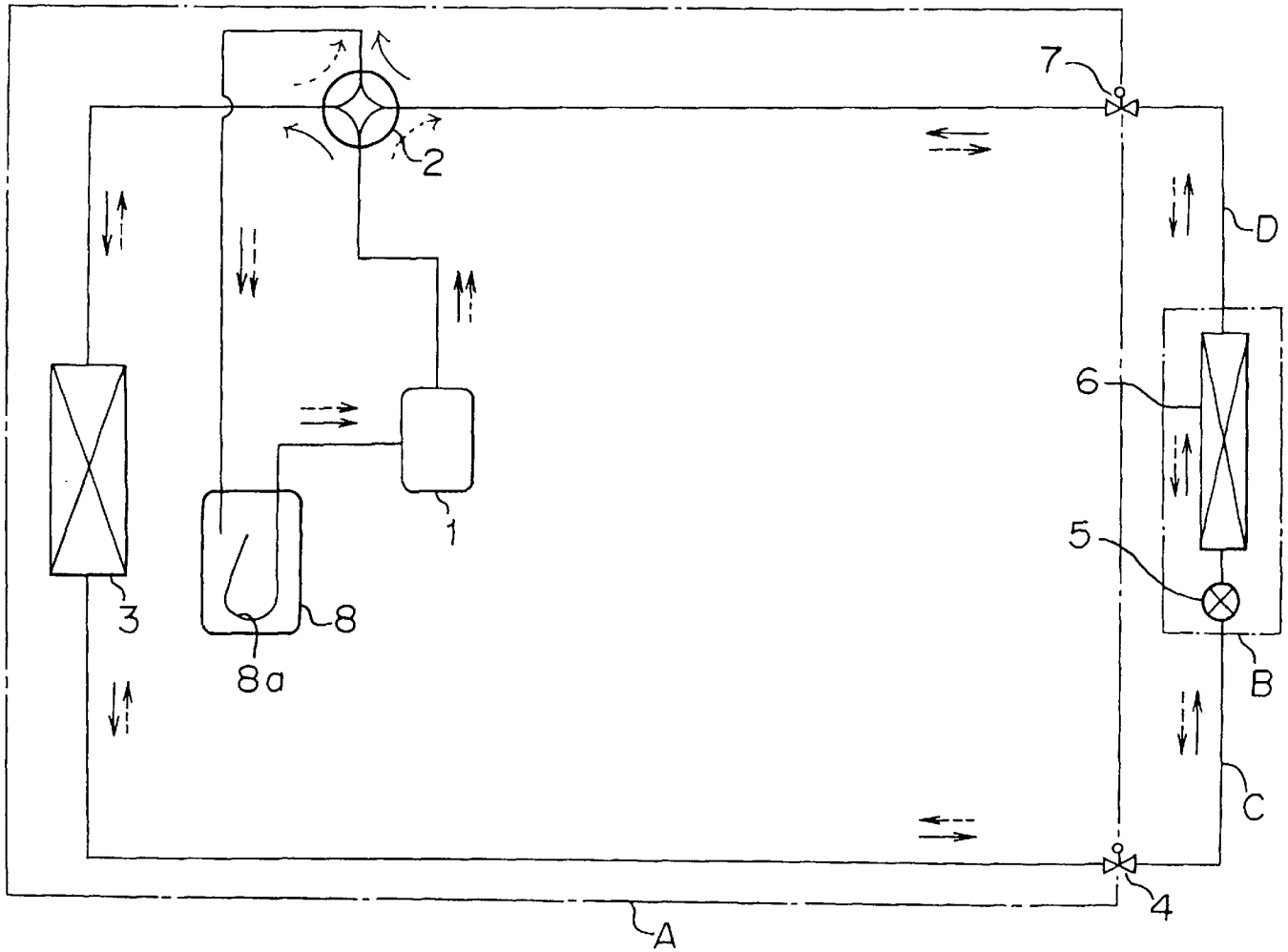
FIG. 11 schematically shows a refrigeration circuit of a conventional air conditioner of separate type.
Figure 12:
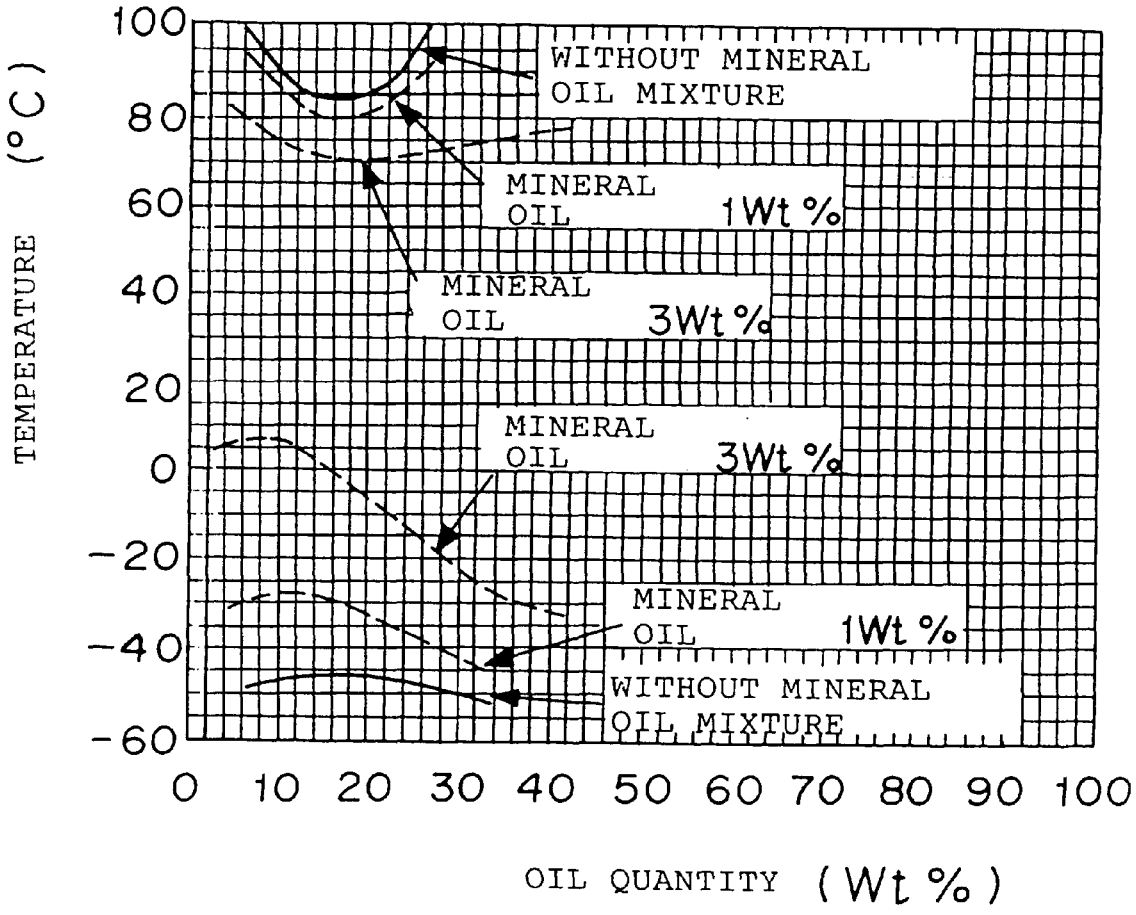
FIG. 12 is a graph showing a critical solubility curve which exhibits solubility between a refrigerating machine oil for HFC and a HFC refrigerant when a mineral oil is included therein.
Figure 13:
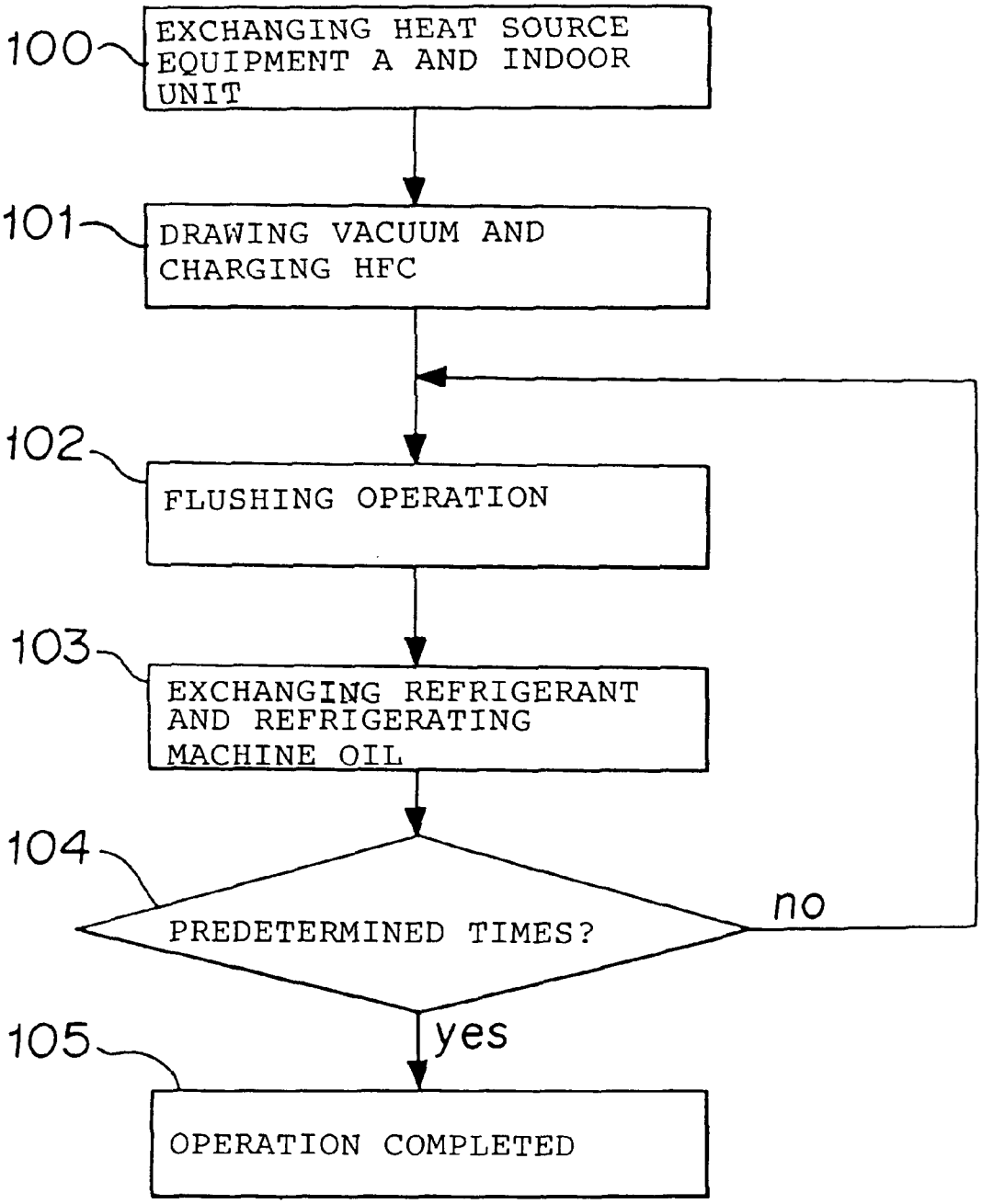
FIG. 13 is a flow chart for explaining a conventional method for flushing an air conditioner.

In the next, ordinary air conditioning operation will be described in reference of FIG. 10. In FIG. 10, an arrow of solid line designates a flow in ordinary operation for cooling and an arrow of broken line designates ordinary operation for heating.

At first, ordinary operation for cooling will be described. A high-temperature high-pressure gas refrigerant compressed by the compressor 1 is discharged from the compressor 1, passes through the four-way valve 2, flows into the heat exchanger on the heat source equipment side 3, and is condensed and liquefied by exchanging heat with a heat source medium such as air and water. The condensed and liquefied refrigerant passes through the first control valve 4, the third control valve 17*a*, the first connection pipe C, and the fifth electromagnetic valve 18*a*, flows into the flow rate adjuster 5 to be depressurized to a low pressure in a low-pressure two-phase state, and is evaporated and vaporized by exchanging heat with a medium on the application side such as air in the heat exchanger in the application side 6.

Thus, evaporated and vaporized refrigerant returns to the compressor 1 through the sixth electromagnetic valve 18*b*, the second connection pipe D, the fourth control valve 17*b*, the second control valve 7, the four-way valve 2, and the accumulator 8.

Because the fifth control valve 17*c* through the eighth control valve 17*f* are closed, the extraneous matter catching means 13 is isolated as a closed space. Therefore, the extraneous matters caught during the flushing operation do not return again to an operating circuit. Further, in comparison with Embodiment 1, since the extraneous matter catching means 13 is not passed, a suction pressure loss of the compressor 1 is small and a drop of capability is small.

In the next, a flow in ordinary operation for heating will be described. A high-temperature high-pressure gas refrigerant compressed by the compressor 1 is discharged from the compressor 1, passes through the four-way valve 2, flows into the second control valve 7, flows into the heat exchanger 6 on the application side through the fourth control valve 17*b*, the second connection pipe D, and the sixth electromagnetic valve 18*b* to be condensed and liquefied by exchanging heat with a medium on the application side such as air.

The condensed and liquefied refrigerant flows into the flow rate adjuster 5, is depressurized to a low pressure therein to be a low-pressure two-phase state, flows into the heat exchanger 3 on the heat source equipment side through the fifth electromagnetic valve 18*a*, the first connection pipe C, the third control valve 17*a*, and the first control valve 4, and is evaporated and vaporized by exchanging heat with a heat source medium such as air and water. The evaporated and vaporized refrigerant returns to the compressor 1 through the four-way valve 2 and the accumulator 8.

Because the firth control valve 17*c* through the eighth control valve 17*f* are closed, the extraneous matter catching means 13 is isolated as a closed space, extraneous matters caught during flushing operation do not return again to an operating circuit. Further, in comparison with Embodiment 1, since the extraneous matter catching means 13 is not passed, a suction pressure loss of the compressor 1 is small and a drop of capability is small. Not like Embodiment 2, a refrigerant does not flow into the cooling means 12*a*, whereby there it no loss of heating capability.

As descried, it is possible to substitute an aged air conditioner utilizing CFC or HCFC for a new air conditioner utilizing HFC with only a heat source equipment A and an indoor unit B newly changed and without changing a first connection pipe C and the second connection pipe D by building an oil separator 9 and an extraneous matter catching means 13 in a flushing machine E. According to such a method, not like the conventional flushing method 1, since an air conditioner is not flushed by a flushing liquid such as HCFC141b and HCFC225 for exclusive use using a flushing machine when existing piping is reused, there is no possibility of destructing the ozone layer, no combustibility, not toxicity, no necessity to care about a remaining flushing liquid, and no need to recover a flushing liquid.

Further, not like the conventional flushing method 2, since it is not necessary to exchange a HFC refrigerant and a refrigerating machine oil for HFC three times by repeating flushing operation three times, requisite quantities of HFC and a refrigerating machine oil is as much as these for one unit, wherein it is advantageous in terms of a cost and the environment. Further, there is no need to store a refrigerating machine oil for exchange and no danger of overcharging and undercharging refrigerating machine oil. Further, it is not necessary to care about incompatibility of a refrigerating machine oil for HFC and deterioration of a refrigerating machine oil.

Further, since the extraneous matter catching means 13 is passed at a time of flushing operation to thereby obtain a flushing effect described in the above and the extraneous matter catching means 13 is isolated as a closed space by closing the fifth control valve 17*c* through the eighth control valve 17*f* at a time of ordinary operation after the flushing operation as a result of installation of the fifth control valve 17*c* through the eighth control valve 17*f*, extraneous matters caught during the flushing operation do not return again to an operating circuit. Further, in comparison with Embodiment 1, since the extraneous matter catching means 13 is not passed, a suction pressure loss of the compressor 1 is small and a drop of capability is small.

Further, by providing the cooling means 12*a*, the heating means 12*b*, the first switching valve 10, and the second switching valve 11, a liquid refrigerant or a gas-liquid two-phase refrigerant flows through the first connection pipe C and the second connection pipe D both in cooling and heating, whereby a flushing effect is high and a flushing time is shortened when flushing the residual extraneous matters.

Further, since it is possible to control a heat exchange rate by the cooling means 12*a* and the heating means 12*b*, it is possible to conduct substantially the same flushing operation under a predetermined condition regardless of an outdoor air temperature and an internal load, whereby an effect and a labor hour are made constant.

Further, by providing the first flow controlling means 15 and the second flow controlling means 16, a refrigerant passing through the first connection pipe C and the second connection pipe D is always in a gas-liquid two-phase state, whereby a flushing effect can be high and a flushing time can be shortened in flushing the residual extraneous matters. Further, because a pressure and a dryness fraction of a gas-liquid two-phase refrigerant passing through the first connection pipe C and the second connection pipe D are controlled, it is possible to conduct substantially the same flushing operation under a predetermined condition and an effect and a labor hour can be made constant.

Further, since the indoor bypass unit F is provided, a state of refrigerant passing through the first connection pipe C and the second connection pipe D is made substantially the same, whereby flushing operation can be uniformly conducted and an effect and a labor hour can be substantially constant. Further, since residual extraneous matters do not flow into a new indoor unit B, contamination of the indoor unit B can be prevented.

Further, since the oil separator 9, the bypass path 9*a*, the cooling means 12*a*, the heating means 12*b*, the extraneous matter catching means 13, the first switching valve 10, the second switching valve 11, the first flow controlling means 15, and the second flow controlling means 16 are built in the flushing machine E, the heat source equipment A can be miniaturized and is made at a low cost. Further, the heat source equipment A can be commonly used even when the first connection pipe C and the second connection pipe D are newly laid.

Further, because the flushing machine E is detachably connected to the air conditioner as a whole at the fifth control valve 17*c* through the eighth control valve 17*f*, flushing operation can be conducted such that a refrigerant in the flushing machine E is recovered by closing these control valves after the flushing operation; the flushing machine E is removed from the air conditioner; and the removed flushing machine E is attached to another air conditioner similar to the above air conditioner.

In this Embodiment 3, an example that one indoor unit B is connected is described. However, a similar effect thereto is obtainable even in an air conditioner in which a plurality of indoor units B are connected in parallel or in serial. Further, it is clear that a similar effect thereto is obtainable even when regenerative vessels containing ice and regenerative vessels containing water (including hot water) are provided in serial to or in parallel to the heat exchanger on the heat source equipment side 3.

Further, a similar effect is obtainable even in an air conditioner in which a plurality of heat source equipments A are connected in parallel. Further, a similar effect is obtainable in, not limited to an air conditioner, a product of a vapor cycle refrigeration system of vapor compression type to which a refrigeration cycle is applied as long as a unit in which a heat exchanger on a heat source equipment side is built and a unit in which a heat exchanger on an application side is built are located apart.

Further, in this Embodiment 3, although only one flushing machine E is provided in one air conditioner, it is clear that a similar effect is obtainable when a plurality of flushing machines are provided.

Embodiment 4

In Embodiment 4, a bung hole for pouring a mineral oil or a tank for a mineral oil is provided between the oil separator 9 of the flushing machine E and the second switching valve 11 in FIG. 9 concerning Embodiment 3. At a time of flushing operation, the mineral oil is supplied to the first connection pipe C and the second connection pipe D to make residual extraneous matters which is sludge of the refrigerating machine oil dissolve in this mineral oil, whereby the connection pipes are flushed and the residual extraneous matters are caught in the extraneous matter catching means 13 as described in Embodiment 3.

Embodiment 5

In Embodiment 5 of the present invention, bung hole for pouring water or a water tank is provided between the oil separator 9 of the flushing machine E and the second switching valve 11 in FIG. 9 concerning Embodiment 3. At a time of flushing operation, this water is supplied to the first connection pipe C and the second connection pipe D to ionize iron chloride, whereby the connection pipes are flushed and extraneous matters are caught by the extraneous matter catching means 13 as described in Embodiment 3.

At this time, a portion of moisture with which a low-pressure refrigerant is supersaturated becomes liquid moisture which moisture detains in a bottom portion of the extraneous matter catching means 13 because a density thereof is larger than that of a mineral oil.

Moisture with which a low-pressure refrigerant is saturated is absorbed by a dryer to thereby reduce moisture in a refrigeration circuit by providing the dryer (a means for absorbing moisture) in any of the heat source equipment A, the first connection pipe C, the second connection pipe D, the third connection pipe CC, and the fourth connection pipe DD.

Meanwhile, in Embodiment 5, it is possible to provide an indoor bypass unit F described in Embodiment 3. Further, in Embodiment 5, it is possible to lock out or separate a portion of refrigeration circuit including the heating means 12*b* and the extraneous matter catching means 13 (the first bypass path) and a portion of refrigeration circuit including the cooling means 12*a* (the second bypass path) from a main pipe of refrigeration circuit, similarly to Embodiment 3.

In addition, as not exemplified thoroughly, the present invention includes combinations and modifications of the above-mentioned features.

Since the present invention is constructed as described above, following effects are obtainable.

The first advantage of the present invention is that solid extraneous matters and liquid extraneous matters in a refrigerant flushed out of existing connection pipes can be sufficiently separated from the refrigerant and caught because an extraneous matter catching means for catching extraneous matters in the refrigerant is provided in a refrigeration circuit between a heat exchanger on an application side to an accumulator; and gaseous extraneous can be caught while the refrigerant passes through the extraneous matter catching means by several times.

The second advantage of the present invention is that solid extraneous matters and liquid extraneous matters can be sufficiently separated from a refrigerant flushed out of existing connection pipes and caught because a first bypass path for bypassing a refrigeration circuit between a heat exchanger on an application side and an accumulator and an extraneous matter catching means for catching extraneous matters in the refrigerant are provided in a cooling circuit; and gaseous extraneous matters can be caught while the refrigerant passes through the extraneous matter catching means by several times.

The third advantage of the present invention is that extraneous matters in a refrigerant flushed out of existing connection pipes can be sufficiently separated and caught because a second bypass path for bypassing a refrigeration circuit between a heat exchanger on a heat source equipment side and a flow rate adjuster, a cooling means for refrigerant, and a heating means for the refrigerant are provided and a heating means for the refrigerant is provided in an upstream side of the extraneous matter catching means of the first bypass path in addition to the structure described in the second advantage of the invention. Additionally, a flushing effect can be made high and a flushing time can be shortened in flushing residual extraneous matters because the heating means and the cooling means respectively for the refrigerant are provided to make a liquid refrigerant or a gas-liquid two-phase refrigerant flow through a connection pipe to an indoor unit at a time of flushing operation. Additionally, substantially the same flushing operation can be conducted under a predetermined condition to thereby make both of an effect and a labor hour constant irrespective of an outdoor temperature and an internal load because a heat exchange rate can be controlled by the heating means and the cooling means.

The fourth advantage of the present invention is that a flushing effect can be made high and a flushing time can be shortened in flushing residual extraneous matters because a first flow controlling means is provided on an upstream side of the heating means in the first bypass path and a second flow controlling means is provided on a downstream side of the cooling means in the second bypass path in addition to the structure described in the third advantage, namely, flow controlling means are provided to control a flow rate of refrigerant flowing into a connection pipe between a heat source equipment and an indoor unit or to control a flow rate of refrigerant flowing out of a connection pipe to the indoor unit in order to render the refrigerant flowing through the connection pipes to the indoor unit a gas-liquid two-phase state without fault. Additionally, substantially the same flushing operation can be conducted under a predetermined condition and an effect and a labor hour can be made constant because a pressure and a dryness fraction respectively of the gas-liquid two-phase refrigerant flowing through the connection pipes are controlled.

The fifth advantage of the present invention is that a refrigerating machine oil for a new refrigerant used in a substituted heat source equipment can be sufficiently separated from a refrigerant and it is possible to prevent the new refrigerant machine oil from flowing into a side of an indoor unit because an oil separating means for separating an oil component of the refrigerant is provided in a cooling circuit of a refrigeration circuit between a compressor and a heat exchanger on a heat source equipment side.

The sixth advantage of the present invention is that a refrigerating machine oil for a new refrigerant used in a substituted heat source equipment can be sufficiently separated from a refrigerant and it is possible to prevent the new refrigerating machine oil from flowing into a side of indoor unit because a third bypass path for bypassing a refrigeration circuit between a heat exchanger on a heat source equipment side and a flow rate adjuster and an oil separating means for separating an oil component of the refrigerant are provided in a cooling circuit.

The seventh advantage of the present invention is that, because an oil separating means for separating an oil component of a refrigerant is provided in a refrigeration circuit between a compressor and a heat exchanger on a heat source equipment side and an extraneous matter catching means is provided in the refrigeration circuit in addition to the structures described in the first advantage through the fourth advantage of the invention, extraneous matters can be sufficiently separated from the refrigerant and caught; a refrigerating machine oil for a new refrigerant can be sufficiently separated from the refrigerant to prevent the new refrigerating machine oil from flowing into a side of the indoor unit; and the extraneous matters in the flushed refrigerant and the new refrigerating machine oil (for example, a refrigerating machine oil for HFC) are not mixed to cause deterioration of the new refrigerating machine oil.

The eighth advantage of the present invention is that, because a third bypass path for bypassing a refrigeration circuit between the heat exchanger on the heat source equipment side and the flow rate adjuster and an oil separator for separating an oil component in a refrigerant are provided in addition to the structure described in the second advantage, extraneous matters can be sufficiently separated from the refrigerant and caught by an extraneous matter catching means provided in a refrigeration circuit of a flushing machine; a refrigerating machine oil for a new refrigerant can be sufficiently separated from the refrigerant by an oil separator to prevent the new refrigerating machine oil from flowing into an indoor unit side; and accordingly the extraneous matters in the flushed refrigerant and the new refrigerating machine oil (for example, a refrigerating machine oil for HFC) are not mixed and the new refrigerating machine oil is not deteriorated.

The ninth advantage of the present invention is that, because an oil separating means for separating an oil component in a refrigerant is provided on an upstream side of the cooling means in the second bypass path in addition to the structure described in the third advantage of the invention, the heating means and the cooling means respectively for the refrigerant can further increase an effect of flushing the extraneous matters in the connection pipes and enhance an effect of catching the extraneous matters; it is possible to prevent a new refrigerating machine oil from flowing into a side of the indoor unit by an oil separator; and the extraneous matters in the flushed refrigerant and the new refrigerating machine oil (for example, a refrigerating machine oil for HFC) are not mixed and therefore the new refrigerating machine oil is not deteriorated.

The tenth advantage of the present invention is that solid extraneous matters and liquid extraneous matters respectively in a refrigerant flushed out of the existing connection pipes can be sufficiently separated and caught; and gaseous extraneous matters can be caught while the refrigerant passes through an extraneous matter catching means by several times because an extraneous matter catching means for catching extraneous matters in the refrigerant is provided in a refrigeration circuit between a heat exchanger on an application side and an accumulator in an operating circuit for cooling and simultaneously between a heat exchanger on a heat source equipment side and the accumulator in an operating circuit for heating.

The eleventh advantage of the present invention is that solid extraneous matters and liquid extraneous matters respectively in a refrigerant flushed out of existing connection pipes can be sufficiently separated and caught; and gaseous extraneous matters can be caught while the refrigerant passes through the extraneous matter catching means by several times because a first bypass path for bypassing the refrigeration circuit between a heat exchanger on an application side and an accumulator in an operating circuit for cooling and bypassing a refrigeration circuit between a flow controller and a heat exchanger on a heat source equipment side in an operating circuit for heating and an extraneous matters catching means for catching extraneous matters in the refrigerant are provided.

The twelfth advantage of the present invention is that, because a second bypass path for bypassing a refrigeration circuit between the heat exchanger on the heat source equipment side and the flow controller in an operating circuit for cooling and bypassing a refrigeration circuit between the compressor and the heat exchanger on the application side in an operating circuit for heating, a cooling means for the refrigerant in the second bypass path, and a heating means for the refrigerant on an upstream side of the extraneous matter catching means in the first bypass path are provided in addition to the structure described in the eleventh advantage of the invention, the extraneous matters in the refrigerant flushed out of existing connection pipes can be sufficiently separated and caught; a flushing effect can be high and a flushing time can be shortened in flushing residual extraneous matters by a flow of a liquid refrigerant or a gas-liquid two-phase refrigerant through the connection pipe to the indoor unit at a time of flushing operation both in the cooling and the heating as a result of providing the heating means and the cooling means respectively for the refrigerant; substantially the same flushing operation can be conducted under a predetermined condition irrespective of an outdoor air temperature and an internal load; and an effect and a labor hour can be made constant by controlling a heat exchange rate in use of the heating means and the cooling means.

The thirteenth advantage of the present invention is that, because a first flow controlling means is provided on an upstream side of the heating means in the first bypass path; and a second flow controlling means is provided on a downstream side of the cooling means in the second bypass path, in addition to the structure described in the twelfth advantage of the invention, namely flow controlling means for controlling a flow rate of refrigerant flowing into a connection pipe between a heat source equipment and an indoor unit and that of refrigerant flowing out of a connection pipe into the indoor unit, the refrigerant flowing through the connection pipe into the indoor unit is always rendered to be in a gas-liquid two-phase state; a flushing effect can be high and a flushing time can be shortened in flushing residual extraneous matters; a pressure and a drying fraction of the gas-liquid two-phase refrigerant flowing through the connection pipe can be controlled; and substantially the same flushing operation can be conducted under a predetermined condition to make an effect and a labor hour constant.

The fourteenth advantage of the present invention is that a refrigerating machine oil for a new refrigerant used in a substituted heat source equipment can be sufficiently separated from the refrigerant; and it is possible to prevent the new refrigerating machine oil from flowing into an indoor unit side because an oil separating means for separating an oil component of a refrigerant is provided in a refrigeration circuit between a compressor and a heat exchanger on a heat source equipment side in an operating circuit for cooling and the refrigeration circuit between the compressor and a heat exchanger on an application side in an operating circuit for heating.

The fifteenth advantage of the present invention is that a refrigerating machine oil for a new refrigerant used in a substituted heat source equipment can be sufficiently separated from the refrigerant; and it is possible to prevent the new refrigerating machine oil from flowing into an indoor unit, because a third bypass path for bypassing a refrigeration circuit between a heat exchanger on a heat source equipment side and a flow controller in an operating circuit for cooling and bypassing a refrigeration circuit between a compressor and a heat exchanger on an application side in an operating circuit for heating and an oil separating means for separating an oil component of the refrigerant are provided.

The sixteenth advantage of the present invention is that, because an oil separating means for separating an oil component of a refrigerant is provided in a refrigeration circuit between the compressor and the heat exchanger on the heat source equipment side in a circuit for cooling and the refrigeration circuit between the compressor and the heat exchanger on the application side in a circuit for heating is provided in addition to the structures described in the tenth advantage through the thirteenth advantage of the invention, the extraneous matters can be sufficiently separated from the refrigerant and caught by an extraneous matter catching means provided in the refrigeration circuit; a refrigerating machine oil for a new refrigerant can be sufficiently separated from the refrigerant by the oil separator to thereby prevent the new refrigerating machine oil from flowing into a side of the indoor unit; and therefore the extraneous matters in the flushed refrigerant and the new refrigerating machine oil (for example, a refrigerating machine oil for HFC) are not mixed and the new refrigerating machine oil is not deteriorated.

The seventeenth advantage of the present invention is that, because an oil separating means for separating an oil component of a refrigerant is provided in a refrigeration circuit between a compressor and the heat exchanger on the heat source equipment side in a circuit for cooling and the refrigeration circuit between the compressor and the cooling means in a circuit for heating in addition to the structure described in the twelfth advantage of the invention, a flushing effect of extraneous matters in a connection pipe can be further enhanced; an effect of catching the extraneous matters can be enhanced by the heating means and the cooling means respectively for the refrigerant; it is possible to prevent the new refrigerating machine oil from flowing into a side of the indoor unit by means of the oil separator; and the extraneous matters in the flushed refrigerant and the new refrigerating machine oil (for example, a refrigerating machine oil for HFC) are not mixed and therefore the new refrigerating machine oil is not deteriorated.

The eighteenth advantage of the present invention is that, because a third bypass path for bypassing a refrigerating circuit between the heat exchanger on the heat source equipment side and the flow controller in a circuit for cooling and bypassing the refrigeration circuit between a compressor and the heat exchanger on the application side in a circuit for heating and an oil separating means for separating an oil component in a refrigerant are provided in addition to the structure described in the eleventh advantage of the invention, extraneous matters can be sufficiently separated from the refrigerant and caught by an extraneous matter catching means provided in a refrigeration circuit of a flushing machine; a refrigerating machine oil for a new refrigerant can be sufficiently separated from the refrigerant by an oil separator provided in the refrigeration circuit; it is possible to prevent the new refrigerating machine oil from flowing into a side of an indoor unit; and therefore the extraneous matters in the flushed refrigerant and therefore the new refrigerating machine oil (for example, a refrigerating machine oil for HFC) are not mixed and the new refrigerating machine oil is not deteriorated.

The nineteenth advantage of the present invention is that because, an oil separating means for separating an oil component of a refrigerant is provided on an upstream side of the cooling means in the second bypass path in addition to the structure described in the twelfth advantage of the invention, an effect of flushing extraneous matters in connection pipes can further be enhanced and an effect of catching the extraneous matters are enhanced by the heating means and the cooling means respectively for the refrigerant; it is possible to prevent a new refrigerating machine oil from flowing into a side of the indoor unit by the oil separator; and the extraneous matters in the flushed refrigerant and the new refrigerating machine oil (for example, a refrigerating machine oil for HFC) are not mixed and therefore the new refrigerating machine oil is not deteriorated.

The twentieth advantage of the present invention is that states of a refrigerant flowing through connection pipes connected to both sides of an indoor unit can be made substantially the same and therefore uniform flushing operation is possible; and an effect and a labor hour can be made constant because an indoor bypass unit for making a refrigerant bypass the indoor unit is provided. Additionally, it is possible to prevent contamination of a new indoor unit because residual extraneous matters do not flow into the newly substituted indoor unit.

The twenty-first advantage of the present invention is that a refrigerating machine oil in a refrigerant discharged from a compressor (for example, a refrigerating machine oil for HFC) can be separated from the refrigerant and returned to the compressor along with a refrigerant in which extraneous matters are taken off; the refrigerating machine oil does not mix with a mineral oil remaining in connection pipes; the refrigerating machine oil for HFC is incompatible with HFC; and the refrigerating machine oil for HFC is not deteriorated by the mineral oil because a return path for returning an oil component separated by an oil separating means to an accumulator on a downstream side of an extraneous matter catching means.

The twenty-second advantage of the present invention is that a mineral oil can be poured into a refrigerant flowing through connection pipes connected to an indoor unit; and residual extraneous matters, which is sludge of a refrigerating machine oil, in the connection pipes can be dissolved in a mineral oil to flush the extraneous matters and caught in an extraneous matter catching means because a mineral oil pouring means for pouring the mineral oil into the refrigerant on a downstream side of an oil separating means is provided in a second bypass path.

The twenty-third advantage of the present invention is that water can be poured into a refrigerant flowing into connection pipes connected to an indoor unit; and therefore iron chloride in the connection pipes can be ionized to flush the extraneous matters and catch these by an extraneous matter catching means because a water pouring means for pouring water into the refrigerant on a downstream side of an oil separating means is provided in a second bypass path.

The twenty-fourth advantage of the present invention is that moisture supersaturated by pouring for the purpose of flushing iron chloride can be absorbed and reduced because a moisture absorbing means for absorbing moisture in a refrigerant is provided in a refrigeration circuit.

The twenty-fifth advantage of the present invention is that extraneous matters in a refrigerant can be separated because a flow rate of the refrigerant is decreased and the extraneous matters in the refrigerant are separated by an extraneous matter catching means.

The twenty-sixth advantage of the invention is that extraneous matters in a refrigerant can be caught because the refrigerant is passed through a mineral oil by a means for catching extraneous matter.

The twenty-seventh advantage of the present invention is that CFC and HCFC in a refrigerant can be dissolved and caught because the refrigerant is passed through a mineral oil by a means for catching extraneous matters.

The twenty-eighth advantage of the present invention is that extraneous matters in a refrigerant can be caught because the refrigerant is passed through a filter by a means for catching extraneous matters.

The twenty-ninth advantage of the present invention is that chloride ions in a refrigerant can be caught because the refrigerant is passed through an ion exchange resin by a means for catching extraneous matters.

The thirtieth advantage of the present invention is that a portion of a bypass path including an extraneous matter catching means can be separated from a main pipe of refrigerant piping; ordinarily operation can be conducted by closing the bypass path after flushing operation; and therefore extraneous matters caught during the flushing operation do not return again to an operating circuit because a first bypass path, a second bypass path, and a third bypass path are detachably provided with respect to a refrigeration circuit. Additionally, a suction pressure loss of a compressor is small and a drop of capability is small because the extraneous mater catching means is not passed through. Additionally, a portion of a flushing machine can be separated from a main pipe of refrigeration piping; and the ordinary operation can be conducted after the flushing operation by closing the flushing machine in a case that the flushing machine is constituted such that an oil separator and the extraneous matter catching means are interposed in the bypass path. Additionally, it is possible to remove the flushing machine after the flushing operation because the flushing machine is separably and detachably provided in a whole refrigeration cycle device.

The thirty-first advantage of the present invention is that a refrigeration cycle device having no problem in terms of environmental protection can be provided because HFC is used as a refrigerant in the structures described in the proceeding advantages of the invention.

The thirty-second and the thirty-third advantages of the present invention is that, because constitutional machines of an existing refrigeration cycle device utilizing a first refrigerant are substituted by those utilizing a second refrigerant and the refrigeration cycle device having structures described in the proceeding advantages of the invention can be formed using existing refrigerant piping, extraneous matters in the existing refrigerant piping are caught; only a heat source equipment and an indoor unit are newly exchanged by preventing a new refrigerating machine oil from flowing into the existing connection pipes; a connection pipe for connecting the heat source equipment to the indoor unit is not exchanged; and the refrigeration cycle device utilizing an aged old refrigerant such as CFC and HCFC is substituted for a refrigeration cycle device utilizing a new refrigerant such as HFC. Additionally, there is no possibility of destructing the ozone layer at all, no combustibility, no toxicity, no need to care about a residual flushing liquid, and no necessity to recover the flushing liquid because the connection pipes are not flushed by a flushing liquid for exclusive use. Additionally, it is advantageous in terms of a cost and the environment because requisite quantities of HFC and the refrigerating machine oil are minimally required. Additionally, there is no need to stock a refrigerating machine oil for exchange, no danger of over-supplying and under-supplying the refrigerating machine oil, no danger of incompatibility of the refrigerating machine oil for HFC, and no danger of deterioration of the refrigerating machine oil.

The thirty-fourth advantage through the thirty-ninth advantage of the present invention are that extraneous matters in connection pipes can be flushed using a bypass pipe before ordinary operation and after a heat source equipment and an indoor unit are newly exchanged because the bypass pipe for bypassing a main pipe of a refrigeration circuit has at least an extraneous matter catching means.

The fortieth and the forty-first advantages of the present invention are that ordinary operation can be conducted by closing a bypass circuit after circulating a refrigerant through the bypass circuit and catching extraneous matters in connection pipes of a refrigeration cycle device in which a heat source equipment and an indoor unit are newly exchanged; and the extraneous matters caught during flushing operation do not return again to an operating circuit because the bypass path including the extraneous matter catching means is isolated as a closed space during the ordinary operation. Additionally, a suction pressure loss of a compressor is small and a drop of capability is small because it is possible to make the refrigerant pass through the bypass circuit during the ordinary operation. Additionally, a refrigerant cycle device can be operated without causing problems concerning environment protection because HFC is used as the refrigerant.

Obviously, numerous modifications and variations of the present invention are possible in light of the above teachings. It is therefore to be understood that within the scope of the appended claims, the invention may be practiced otherwise than as specifically described herein.

What is claimed is:

1. A refrigeration cycle device having a first refrigeration circuit for circulating a refrigerant from a compressor through a heat exchanger on a heat source equipment side, a flow rate adjuster, a heat exchanger on an application side, and an accumulator in a sequential manner to said corressor, comprising:

an extraneous matter catching means for catching extraneous matters in said refrigerant provided between said heat exchanger on the heat source equipment side and said accumulator in said first refrigeration circuit;

a first bypass path for bypassing a refrigeration circuit between said heat exchanger on the application side and said accumulator of said first refrigeration circuit, wherein said first bypass path includes said extraneous matter catching means;

a second bypass path for bypassing a refrigeration circuit between said heat exchanger on the heat source equipment side and said flow rate adjuster in said first refrigeration circuit;

a cooling means for refrigerant provided in said second bypass path; and a heating means for refrigerant provided on an upstream side of said extraneous matter catching means in said first bypass path.

2. A refrigeration cycle device according to claim 1, further comprising:

a first flow controlling means provided on an upstream side of said heating means in said first bypass path, and a second flow controlling means provided on a downstream side of said cooling means in said second bypass path.

3. A refrigeration cycle device according to claim 2, further comprising:

an oil separating means for separating an oil component in said refrigerant provided between said compressor and said heat exchanger on the heat source equipment side in said first refrigeration circuit.

4. A refrigeration cycle device according to claim 1, further comprising:

an oil separating means for separating an oil component of said refrigerant provided on an upstream side of said cooling means in said second bypass path.

5. A refrigeration cycle device according to claim 1, further comprising:

a third bypass path for bypassing a refrigeration circuit between said heat exchanger on the heat source equipment side and said flow rate adjuster in said first refrigeration circuit; and an oil separating means for separating an oil component of said refrigerant provided in said third bypass path.

6. A refrigeration cycle device according to claim 5, wherein said first bypass path is freely detachable from sad refrigeration circuit.

7. A refrigeration cycle device according to claim 1, further comprising:

a mineral oil pouring means for pouring a mineral oil into said refrigerant on a downstream side of said oil separating means in said second bypass path.

8. A refrigeration cycle device according to claim 7, further comprising:

a water pouring means for pouring water into said refrigerant on a downstream side of said oil separating means in said second bypass path.

9. A refrigeration cycle device according to claim 8, further comprising:

a moisture absorbing means for absorbing moisture in said refrigerant provided in said refrigeration circuit.

10. A refrigeration cycle device according to claim 1, further comprising:

an indoor unit bypass path for controlling bypass of said flow rate adjuster and said heat exchanger on the application side.

11. A refrigeration cycle device according to claim 1, wherein:

said extraneous matter catching means separates extraneous matters in said refrigerant by decreasing a flow rate of refrigerant at a part of said refrigeration circuit.

12. A refrigeration cycle device having a first refrigeration circuit for circulating a refrigerant from a compressor through a heat exchanger on a heat source equipment side, a flow rate adjuster, a heat exchanger on an application side, and an accumulator in a sequential manner to said compressor, comprising:

an oil separating means for separating an oil component of said refrigerant provided between said compressor and said heat exchanger on the heat source equipment side in said first refrigeration circuit; and a bypass path for bypassing a refrigeration circuit between said heat exchanger on the heat source equipment side and said flow rate adjuster in said first refrigeration circuit, wherein said bypass path includes said oil separating means.

13. A method of operating a refrigeration cycle device having a first refrigeration circuit for circulating a refrigerant from a compressor through a heat exchanger on a heat source equipment side, a flow rate adjuster, a heat exchanger on an application side, and an accumulator in a sequential manner to said compressor, comprising the steps of:

providing a first bypass path between said heat exchanger on the application side and said accumulator;

providing an extraneous matter catching means for catching means for catching extraneous matters in said refrigerant in a middle of said first bypass path, and circulating said refrigerant through said first bypass path to make said extraneous matter catching means catch the extraneous matters in said refrigerant.

14. A method of operating a refrigeration cycle device according to claim 13, further comprising the steps of:

providing a second bypass path between said heat exchanger on the heat source equipment side and flow rate adjuster;

providing a cooling means for refrigerant in a middle of said second bypass path;

providing a heating means for refrigerant on an upstream side of said extraneous matter catching means of said first bypass path, and heating said refrigerant to transform into a gas phase by said heating means.

15. A method of operating a refrigerant cycle device according to claim 13, further comprising the steps of:

closing at least said first bypass path; and conducting ordinary operation by circulating a new refrigerant through said first refrigeration circuit.

16. A method of operating a refrigeration cycle device according to claim 13, wherein;

said refrigerant is hydro fluoro carbon.

* * * * *

UNITED STATES PATENT AND TRADEMARK OFFICE

CERTIFICATE OF CORRECTION

PATENT NO. : 6,223,549 B1
DATED : May 1, 2001
INVENTOR(S) : Kasai

It is certified that error appears in the above-identified patent and that said Letters Patent is hereby corrected as shown below:

Title page,
The CPA information has been omitted. It should read as follows:
-- [45] **Date of Patent: *May 1, 2001** --

-- Notice: This patent issued on a continued prosecution application filed under 37 CFR 1.53(d), and is subject to the twenty year patent term provisions of 35 U.S.C. 154(a)(2). --

Signed and Sealed this

Eighteenth Day of December, 2001

*Attest:*

*Attesting Officer*

JAMES E. ROGAN
*Director of the United States Patent and Trademark Office*